US006949331B2

(12) United States Patent
Ishikawa

(10) Patent No.: US 6,949,331 B2
(45) Date of Patent: Sep. 27, 2005

(54) METHOD OF REUSING PHOTOGRAPHIC PROCESSING WASTE SOLUTION, AND PHOTOGRAPHIC PROCESSING AGENT

(75) Inventor: Takatoshi Ishikawa, Kanagawa (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 8 days.

(21) Appl. No.: 10/785,066

(22) Filed: Feb. 25, 2004

(65) Prior Publication Data

US 2004/0229172 A1 Nov. 18, 2004

(30) Foreign Application Priority Data

Feb. 26, 2003 (JP) ..... P-2003-049202

(51) Int. Cl.[7] ..... G03C 5/31; G03C 5/395; G03C 7/44

(52) U.S. Cl. ..... 430/398; 430/399; 430/400

(58) Field of Search ..... 430/398, 399, 430/400

(56) References Cited

U.S. PATENT DOCUMENTS 3,891,495 A * 6/1975 Baird ..... 159/6.3
2004/0052517 A1 * 3/2004 Nomura et al. ..... 396/564
2005/0069820 A1 * 3/2005 Nomura ..... 430/398

FOREIGN PATENT DOCUMENTS

JP 10-288829 A 10/1998
JP 2000024402 * 1/2000

OTHER PUBLICATIONS

JP–A–10–288829 with respect to "Concise explanation of document".*
Machine translation and Abstracts of JP–2000024402.*

* cited by examiner

*Primary Examiner*—Hoa Van Le
(74) *Attorney, Agent, or Firm*—Birch, Stewart, Kolasch & Birch, LLP

(57) ABSTRACT

A method of enabling reuse of photographic processing waste solutions with ease at low cost without discharging effluents in a substantial sense, and a photographic processing agent regenerated by such a method are provided, which is a method of reusing a photographic processing waste solution, in which a solidified matter is prepared from the photographic processing waste solution by a dry-solidification according to a thin film concentration method without removing ingredients accumulated during a processing, the solidified matter is formed into granules, and the granules is reused as a solid photographic processing agent: and a regenerated processing agent prepared by the aforesaid method.

10 Claims, 1 Drawing Sheet

METHOD OF REUSING PHOTOGRAPHIC PROCESSING WASTE SOLUTION, AND PHOTOGRAPHIC PROCESSING AGENT

This Nonprovisional application claims priority under 35 U.S.C. § 119(a) on Patent Application No(s). P-2003-049202 filed in JAPAN on Feb. 26, 2003, the entire contents of which are hereby incorporated by reference.

FIELD OF THE INVENTION

The present invention relates to reuse of a waste solution discharged through photographic processing or silver halide photosensitive materials and, more specifically, to a method of reusing a photographic processing waste solution as a solid processing agent for silver halide photographic materials, and further to a regenerated photographic processing agent. In particular, the invention is concerned with a method of reusing a photographic processing waste solution as a solid processing agent for color photographic materials and with a regenerated photographic processing agent.

BACKGROUND OF THE INVENTION

In photographic processing after exposure to light, silver halide photographic materials generally undergo a developing step, a desilvering step, a washing step and a drying step in succession. A color developer, a bleach-fix bath and a rinsing bath (and/or a stabilizing bath) used in individual processing steps are each replenished with a given amount of replenishing agent at every time when the processing quantity of photographic materials amounts to a predetermined value.

As to photographic waste solutions discharged as the quantity of silver halide photographic materials processed is increased, it has been strongly required in recent years from the viewpoint of environmental load to reduce the waste solution volume by adoption of replenishment rate-reduced processing and reclamation of spent processing solutions. As a medium for reduction of the waste solution volume, apparatus for concentrating waste solutions by reduced-pressure distillation is already in the actual use, and contributes to reduction in frequency of waste solution recovery and downsizing of storage space of waste solutions. However, as the apparatus consumes energy and does not aim to reuse waste solutions, it is difficult to say that the use of such apparatus is environmentally favorable. On the other hand, regeneration use of photographic waste solutions, especially regeneration use involving reduction in waste solution volume by concentration, requires a high-skill adjustment in ingredients of each processing solution. Therefore, the regeneration use is generally difficult to carry out in the so-called mini lab. And the regeneration use is performed almost exclusively in large-scale photofinishing laboratories (large lab) for not only the foregoing reason but also another reason that the large lab is a place large in processing quantity and favorable for management and activity maintenance of processing solutions, including waste solutions.

In mini lab, on the other hand, the processing quantity is small and waste solutions undergo deterioration with a lapse of time, so it is difficult to maintain the quality of waste solutions at a level enabling reuse thereof, and besides, there is a technical limit as mentioned above. Thus, the on-site regeneration processing as mentioned above cannot be performed. Such being the case, it is customary to store waste solutions and deliver over the stored ones to a waste solution recoverer to outsource the recovery processing. However, finding a space for storing waste solutions is required for the recovery processing to be outsourced, and it is further required to address laws and regulations governing the storage of specific industrial wastes.

With a recent trend toward widespread distribution of photofinishing laboratories, it has become an important challenge to find a convenient wastes-processing measure enabling solution of eco-friendliness problems in mini lab, especially to develop a convenient method for reusing waste solutions.

As an example of the method of reducing the volume of waste solutions by reduced-pressure distillation, mention may be made of the method disclosed in Patent Document 1 cited below, wherein processing waste solutions are solidified into powders and reused as solid processing chemicals. When a fixation waste solution is solidified into powder as it is and reused as a solid processing chemical, the fixation waste solution-originated silver ions cause an increase of silver ion concentration to result in inhibition on the desilvering of photosensitive materials. In such a reuse mode, therefore, silver ions are eliminated from the fixation waste solution by, e.g. electrolysis in advance of water removal, and then the resulting waste solution is solidified. This solidified matter is reused in its entirety, and regenerated as a solid processing chemical by supplementation with ingredients reduced by photographic processing.

However, the aforesaid mode requires an apparatus for eliminating silver ions, so a space to install the apparatus becomes necessary and thereby an increase in cost is caused. In addition, other chemical ingredients undergo degradation by oxidation during the elimination of silver ions, and it is impossible to solidify a small amount of waste solution without loss. Therefore, it cannot be said that the foregoing mode is a desirable mode.

In addition, electrolytic reduction of Ag ions gives rise to production of $Ag_2S$ and a decrease in bleaching activity with Fe(II) formation by simultaneous reduction of Fe(III) as a bleaching constituent. As a result, the running of rapid processing under use of the solid processing chemicals regenerated in the aforementioned mode creates new problems that cyan discoloration occurs, filters become clogged and stains are left on the sensitive materials processed.

Moreover, reduced-pressure distillation as a method for reducing the volume of waste solutions requires a vacuum pump for pressure reduction and, when excessive heat is applied to waste solutions during the distillation, there is a fear of evolution of decomposition gasses because a bleach-fix bath contains an ammonium salt and a sulfite. Thus, the application of reduced-pressure distillation as a measure against waste solutions in mini lab leaves problems in need of solution.

The following document is Patent Document 1 cited above as the background art relating to this invention.

Patent Document 1: JP-A-10-288829

SUMMARY OF THE INVENTION

The invention aims to provide a method of reusing a photographic processing waste solution, which enables a photographic processing waste solution to be reused with ease and at low cost, produces no waste solution in a substantial sense and is practicable even in a small-scale photo lab, such as mini lab.

As a result of our intensive studies of the aforementioned problems, it has been found that, when a photographic processing waste solution is subjected to dry-solidification without removing accumulated ingredients including silver ion, and the solidified matter thus obtained is reused in a required amount, problems including cyan discoloration, clogging of filters and stains on sensitive materials are not caused even in the running of rapid processing and it becomes possible to reuse a photographic processing waste solution with ease and at low cost. On the basis of this finding, the invention has reached completion.

More specifically, the invention includes embodiments as mentioned below:

1. A method of reusing a photographic processing waste solution, comprising:

preparing a solidified matter from the photographic processing waste solution by a dry-solidification according to a thin film concentration method without removing ingredients accumulated during a photographic processing;

forming the solidified matter into granules; and reusing the granules as a solid photographic processing agent.

2. The method as described in the item 1, which further comprises gathering waste solutions discharged in individual steps of photographic processing; and mixing the gathered waste solutions without removing ingredients accumulated in the individual steps.

3. The method as described in the item 1 or 2, which further comprises adding a chemical consumed during the photographic processing.

4. The method as described in any one of the items 1 to 3, wherein the photographic processing waste solution is a waste solution generated by a color paper processing.

5. The method as described in any one of the items 1 to 4, wherein the solidified matter is prepared from the photographic processing waste solution by a dry-solidification according to a thin film concentration method at a temperature of 80° C. or below.

6. The method as described in any one of the items 1 to 4, wherein the solidified matter is prepared from the photographic processing waste solution by a dry-solidification according to a thin film concentration method at a temperature of 80° C. or below under a reduced pressure.

7. The method as described in any one of the items 1 to 6, wherein the solidified matter is prepared from the photographic processing waste solution by a dry-solidification according to a thin film concentration method without removing at least silver accumulated during the photographic processing.

8. The method as described in any one of the items 1 to 7, wherein a reuse rate is from 70% to 90%, in which the reuse rate is defined as a rate by weight of the amount of the solid matter obtained from the photographic waste solutions and reused as a replenishing agent to the total amount by weight of the solid matter obtained from the photographic waste solutions.

9. The method as described in any one of the items 1 to 8, which further comprises: recovering water vapor produced at the time of the dry-solidification of the photographic waste solutions; and liquefying the water vapor to utilize the water as the water for diluting the bleach-fix processing solution or the water of the rinsing bath.

10. The method as described in any one of the items 1 to 9, wherein the photographic processing waste solution is a mixture of processing waste solutions discharged in a development-processing step, a bleach-fix processing step and at least one of a rinse and stabilization-processing step.

11. A solid photographic replenishing agent produced in accordance with the method as described in any one of the items 1 to 10.

A feature of the invention consists in that the invention enables waste solutions discharged in photographic processing steps to be used as a regenerated processing agent or regenerated processing agents by carrying out dry-solidification of the waste solutions in accordance with a thin film concentration method without removing ingredients accumulated during the photographic processing, including silver ion. More specifically, the invention gives a concrete form to the finding that the thin film concentration method makes it possible to efficiently dry-solidify waste solutions in a short time at a low temperature and enables the reuse of waste solutions without removal of ingredients accumulated during the photographic processing. According to this method, waste solutions can escape deteriorating with a lapse of time during the storage, the dry-solidification of waste solutions can be carried out in each individual photo lab and a limited space suffices for the storage of waste solutions. Therefore, the present method can be carried out even in a small-scale photo lab, such as a mini lab, without causing any trouble from technological, economical and photo-quality keeping aspects. Thus, the problems of the invention are solved.

In regenerating a waste solution as a solid processing agent, chemicals consumed during the processing are added to the dry-solidified waste solution on an as needed basis.

Regeneration of processing chemicals by use of dry-solidified waste solutions may be performed not only inside each individual photo lab (on-site regeneration) but also in an appropriate institution outside each individual photo lab (off-site regeneration). The off-site regeneration is, however, preferable.

The regenerated processing chemicals are supplied in the form of a solid agent, so they are stable though they are formulated into one agent, don't have to require a lot of packaging material, and permit reductions in transportation load and waste package disposal.

DETAILED DESCRIPTION OF THE INVENTION

Figure 1:
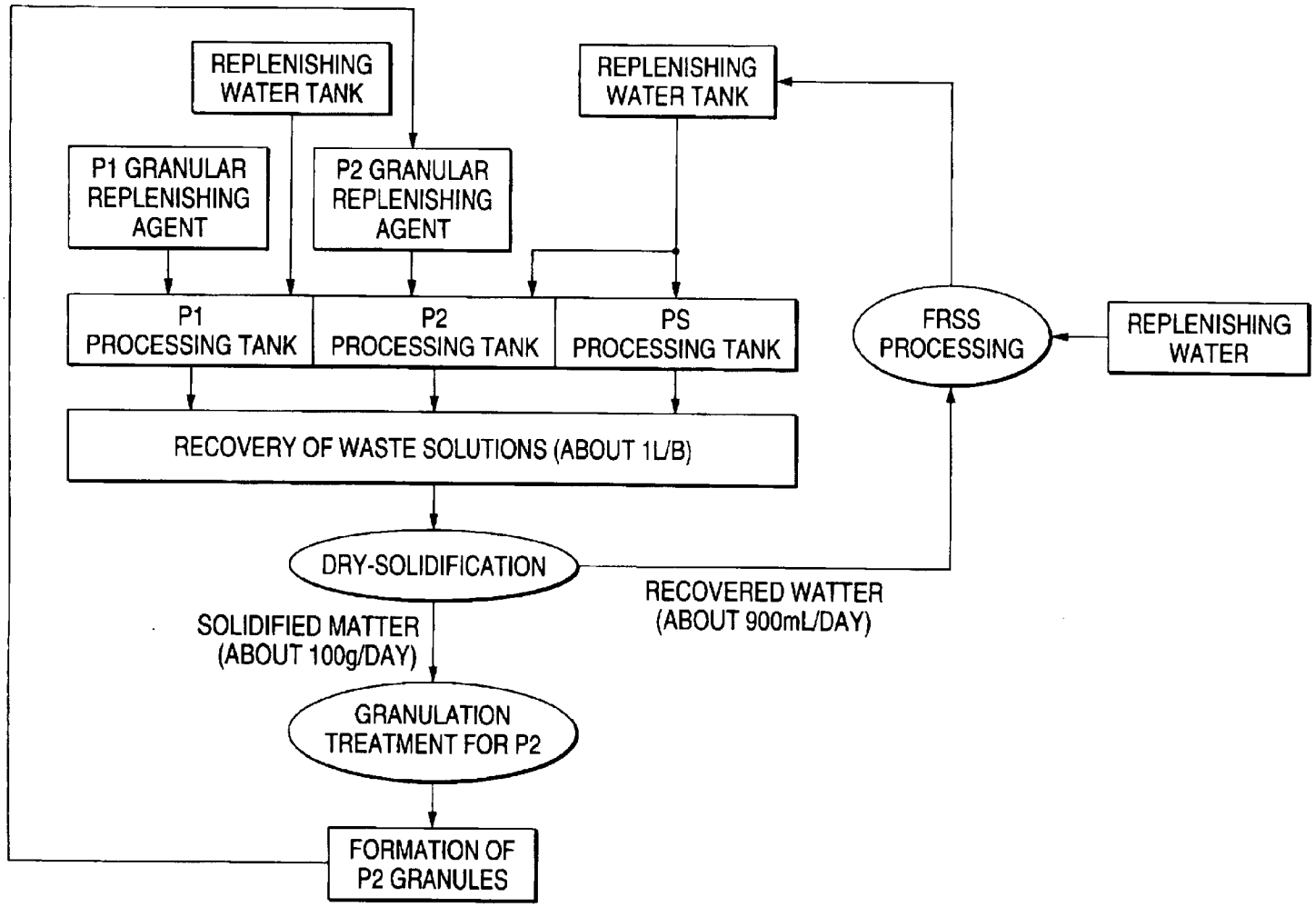
FIG. 1 is a schematic block diagram showing the waste-solution reuse process according to a typical embodiment of the present method for reusing photographic processing waste solutions.

The invention is illustrated below in detail.

The invention can be applied to every photographic processing carried out in photographic markets and, more specifically, to photographic processing for any of photographic materials including color negative materials, color papers, color reversal materials and black-and-white photographic materials. Further, the invention may be applied to a specific processing waste solution chosen from those discharged in individual processing steps or the invention may be applied to a mixture prepared by gathering all waste solutions discharged. In particular, it is advantageous to apply the invention to waste solutions generated by color paper processing.

Suitable examples of a processing solution to which the invention is applicable when the solution is wasted include a developing solution, a bleaching solution and a fixing solution used in color negative processing, a developer and a bleach-fix bath and a stabilizer or/and a rinsing bath used in color paper processing, first and color developers, a bleaching solution and a fixing solution used in color reversal processing, and a developing solution and a fixing solution used in black-and-white development processing. Of these processing solutions, a bleach-fix bath, a bleaching solution and a fixing solution are preferred in applying the invention, because these solutions have relatively good tolerances on the variation in composition. And it is far preferable that the invention is applied to a bleach-fix bath in color paper processing. In particular, it is advantageous to apply the invention to a mixture of waste solutions generated by a developer and a bleach-fix bath in color paper processing or a mixture of waste solutions generated by not only a developer and a bleach-fix bath but also a rinsing bath or/and a stabilizer in color paper processing.

In accordance with solidification of waste solutions by a thin film concentration method adopted in the invention, the waste solutions can be efficiently dried at low temperatures of 80° C. or below (under a reduced pressure when required). Owing to excellent heat transfer effect of thin film, the solidification can proceed in a short time, compared with a general reduced-pressure distillation method, so the decomposition or deterioration of ingredients is reduced (therefore evolution of poisonous gasses is suppressed), and much energy doesn't have to be consumed.

In producing a solid regenerated processing agent, such as a solid replenishing agent, it is preferable to carry out granulation as mentioned below, especially formation of granules having a core/shell structure. However, the regenerated processing agent may have a tablet shape. Further, it is appropriate to enhance the stability of the solid processing agent by coating treatment. Details thereof are also described below.

In the invention, silver removal (or desilvering) by, e.g., electrolysis as disclosed in JF-A-10-288829 is not conducted. This is because the silver removal requires an apparatus for its exclusive use and a space to install the apparatus, thereby bringing about an increase in cost. In other words, this step is not adequate for the present purpose of reusing a photographic processing waste solution with ease and at low cost. Further, the electrolytic reduction of silver ions causes new problems that $Ag_2S$ is produced and bleaching activity is decreased with Fe(II) formation by simultaneous reduction of Fe(III) as a bleaching constituent; as a result, the running of rapid processing under use of the solid processing chemicals regenerated in such a mode causes cyan discoloration, clogging of filters and contamination of the sensitive materials processed (these problems are serious particularly in the case of bleach-fix bath waste). On the other hand, these points are cleared up by the present method in which the silver removal is not conducted.

In the invention, a photographic processing waste solution is solidified, granulated, and then reused as a solid processing agent. The expression "solid processing agent" used herein is intended to include processing agents which are in tabular, granular, powdery, massive and pasty states, respectively. Of the agents in these sates, the agent in a granular form is preferred over the others. In granulating the solidified matter of a photographic processing waste solution, constituent chemicals (e.g., chemicals which has become deficient by consumption during the processing) can be added on an as needed basis.

A regenerated replenishing agent relating to the invention may be produced by, as mentioned above, admixing the solidified matter of a waste solution with the required constituent chemicals and then granulating the admixture, or by forming the solidified matter of a waste solution into granules and then mixing the granules with the required constituent chemicals in a solid state (e.g., in a granular form).

Now, the present reuse method of a photographic processing waste solution is illustrated by reference to FIG. 1.

FIG. 1 is a schematic process diagram illustrating the present reuse method of a photographic processing waste solution by taking as an example the application to color paper processing operations, or the case especially advantageous to the invention.

In general, photographic processing of photosensitive materials after exposure to light includes carrying out color development processing in the P1 processing tank, then carrying out bleach-fix processing in the P2 processing tank, further carrying out wash processing in the PS processing tank, and finally carrying out drying the photosensitive materials. As described above, a color developer (P1), a bleach-fix bath (P2) and a rinsing bath (PS) are replenished with their respective replenishing agents in given amounts at every time when the processing quantity of photographic materials amounts to a predetermined value. In FIG. 1, the P1 and P2 processing solutions are replenished by granular replenishing agents being charged into their respective processing tanks and dissolved by use of replenishing water. The overflow from each processing tank, namely a processing waste solution, is dry-solidified and, in many cases, admixed with constituent chemicals consumed during the processing on an as needed basis, and further granulated. The granules thus obtained are reused as a granular replenishing agent.

FIG. 1 shows a typical embodiment of the invention, wherein P1, P2 and PS waste solutions are mixed together and dry-solidified by one operation. On the other hand, these waste solutions each may be dry-solidified independently without being mixed, and reused individually. This mode is another embodiment of the invention.

In FIG. 1, the dry-solidifying step, the granulating step and the P2 granules-producing step are shown independently. However, these steps may also be combined into one or two steps depending on apparatus used and regeneration site conditions.

In the invention, waste solutions are recovered from their respective processing tanks, and solidified. As the method of solidifying the waste solutions, it is desirable to adopt a thin film concentration method. The reduced-pressure distillation method hitherto used is undesirable because there is a fear of evolving gases by decomposition of ammonium and sulfurous acid salts contained in a bleach-fix bath when excessive heat is applied to the waste solutions. On the other hand, the dry-solidification by a thin film concentration method has less possibility of evolving gases by the decomposition than the reduced-pressure distillation method because the thin film concentration method is less prone to apply excessive heat and shorter in heating time, and besides, according to our finding, the solid processing agent regenerated by the thin film concentration method has an effect of inhibiting contamination of photosensitive materials when it is used in continuous photographic processing. The thin film concentration apparatus used in the invention can be chosen from, for example, EYELA Thin Film Evaporators (made by EYELA TOKYO RIKAKIKAI CO.) of various types, such as MF and F types, depending on the processing quantity required. However, the apparatus usable in the invention should not be construed as being limited to the above ones, but other commercially available devices can also be used. In a favorable apparatus, its contact part with the thin film of evaporated liquid is adjusted to a temperature of 100° C. or below, preferably 80° C. or below. For enabling evaporation at low temperatures, it is also preferable to adopt a reduced-pressure method into the apparatus.

Further, the water vapor produced at the time of solidification of waste solutions is liquefied using an appropriate condensation method, and can be utilized as the water for diluting the bleach-fix processing solution (P2) or as the rinsing bath (PS). In addition, the liquefied water vapor can also be used for cleaning P2–PS crossover rollers. In the mode shown in FIG. 1, the tank denoted by FRSS refers to a storage tank of the condensed water used for those purposes.

The processing agent obtained by regeneration of photographic waste solutions contains accumulation formed during the photographic processing, e.g., as is the case where the bleach-fix waste solution contains silver ions. When photographic processing is carried out using the regenerated processing agent in its total amount without removal of accumulation, the accumulation concentration, such as silver ion concentration, in the processing solution is increased and causes deterioration in processing quality. Therefore, the suitable reuse rate is from 50% to 95%, preferably from 70% to 90%. The term "reuse rate" as used herein refers to a proportion of the amount (by weight) of solid matter obtained from photographic waste solutions and reused as a replenishing agent to the total amount (by weight) of solid matter obtained from photographic waste solutions, and it is defined by the following equation:

Reuse rate (%)=[(amount (g) of replenishing agent-incorporated portion of solid matter obtained from photographic waste solutions)+(total amount (g) of solid matter obtained from photographic waste solutions)]×100

Incidentally, the portion of the solid matter not reused as a solid processing agent is disposed of in known ways. For instance, it undergoes treatments, such as anaerobic fermentation and aerobic fermentation, and thereby silver sulfide and sulfur are recovered and the residue is used as fertilizer for lawn, or it undergoes biological and chemical treatments for COD reduction to an ecologically safe level and then discharged into sewerage.

The granules of a solid processing agent for silver halide photographic materials, which is usable as a preferred mode of the present method of reusing a photographic waste solution, is illustrated below.

The solid matter obtained by dry-solidification of a waste solution is granulated for regeneration, and reused as a solid processing agent. The solid processing agent may be prepared by granulating the dried-and-solidified matter as it is, or by forming the dried-and-solidified matter into granules of a core/shell structure.

The granules of a core/shell type grain structure are described below. In describing the present photographic processing agent with a core/shell type grain structure, general compositions and designs of core/shell-type granular processing agents are described to begin with.

The granules with a core/shell type grain structure are granules in which the ingredients making up a processing agent are present in a state that they are divided between the internal nucleus constituents (core constituents) and the coating layer constituents (shell constituents). As to the way of dividing the ingredients between the core and the shell, it is appropriate that the ingredients are divided into two groups (1) and (2) namely (1) hygroscopic compounds alone or a mixture of hydroscopic compounds with small amounts of other ingredients miscible with the hygroscopic compounds and (2) a single ingredient other than (1) and a mixture of other ingredients miscible with one another, according to known chemical knowledge, and the group (1) is allocated to the internal nucleus constituents (core constituents) and the group (2) is allocated to the coating layer constituents (shell constituents). Further, the coating layer can be formed so as to have a multilayer structure including at least three layers. Besides the forgoing way, the granules may be formed by optimizing allocation of ingredients according to another guideline for designing granules.

The core/shell structure achieves its effect especially when the internal nucleus as the core contains a highly hygroscopic ingredient having a low critical relative humidity of 70% RH or below (the term "critical relative humidity" used herein refers to the relative humidity of the air in humidity equilibrium with a processing chemical). Examples of an ingredient having a critical relative humidity of 70% RH or below include hydroxides of alkali metals, thiosulfates, potassium carbonate, hydroxylamine sulfate, and ammonium salts such as ammonium sulfite. More effect can be achieved by using the internal nucleus having a critical relative humidity of 60% RH or below. And it is practical to use the internal nucleus having a critical relative humidity of 5% RH or above. In the case of containing a hydroxide of alkali metal in the internal nucleus, the effect becomes pronounced when the hydroxide of alkali metal is lithium hydroxide. When the internal nucleus is made up of a thiosulfate, it is preferable that the thiosulfate is the ammonium or sodium salt, and the ammonium salt in particular can render the effect remarkable. In addition, it is preferable that the ingredients having critical relative humidities of 70% RH or below constitute at least 50 mass % of the internal nucleus, and the effect becomes especially pronounced when the proportion of those ingredients in the internal nucleus is from 60 to 100 mass %. The core/shell solid processing chemicals as mentioned above are disclosed in JP-A-2001-183779.

In reusing a photographic waste solution as core/shell-type granules of a solid processing agent, the invention basically adopts the aforementioned philosophy in designing core/shell-type granules of a solid processing agent. Therefore, the granules with core/shell structures as described below in detail are designed in the invention.

Constituent chemicals of a processing solution and ingredients produced and accumulated during the processing constitute a dry-solidified matter in the invention. In general, such a dry-solidified matter has a critical relative humidity of 70% RH or above. In many cases, therefore, the granules with a core/shell structure are formed by granulating the dry-solidified matter to form core particles as internal nuclei, and then by coating the internal nuclei with ingredients to be newly added as replenishing chemicals because they are consumed during the processing. However, when the ingredients to be added are chemicals having critical relative humidities lower than the solidified matter, such as hydroxides of alkali metals, it is preferable that the core is formed of such chemicals and the shell layer is formed on the core surface by use of the dry-solidified matter. Further, granules with a multilayer structure can also be formed by providing a layer or layers of other addition chemicals on the shell layer.

By forming granules into a multilayer structure, it is possible to divide constituent compounds of the granules into more stable groups and allot the groups among layers.

When the internal nucleus surface is covered with three or more coating layers in the granules of the present regenerated solid processing agent, it is appropriate that the number of the coating layers be from 3 to 10, preferably from 3 to 5. The composition of each coating layer is made up of some ingredients of a processing agent as described below, preferably ingredients of a processing agent, other than hydroxides of alkali metals and thiosulfates. Besides the ingredients of processing agents, development-inactive substances, such as inorganic salts and water-soluble polymers, can also be contained in the coating layers from the viewpoints of binding capability, stability and mechanical strength. It is preferable that the critical relative humidity of coating layers as the shell part is higher than that of the internal nucleus. Further, it is appropriate that the critical relative humidity of coating layers be 70% RH or higher. And it is favorable that the total mass of coating layers is at least a half as much as the mass of internal nucleus. In particular, it is advantageous that the total mass of coating layers is equivalent with or greater than the mass of internal nucleus.

The term "spherical granules" as used in the invention refers to the granules formed by granulating a powdery (solidified) matter in a spherical shape. The spherical shape may be a perfect sphere or not, and can include granular shapes generally referred to as the so-called pellet, pill and bead. The suitable average diameter of granules is from 0.5 to 20 mm, preferably from 1 to 15 mm, particularly preferably 2 to 10 mm. And the effect becomes pronounced when the proportion of granules having average diameters smaller than 0.5 mm is at most 10 mass %, preferably 0 to 5 mass %, of the granular solid processing agent.

In a solid processing agent regenerated in accordance with the present reuse method of waste solutions, the internal nuclei can be granules formed in various shapes, such as spherical, columnar, prism-like and indefinite shapes. Of these shapes, the spherical shape is preferred from the standpoint of the ease in coating many ingredients on each internal nucleus, while the indefinite shape is preferred from the standpoint of the ease in producing internal nuclei. The suitable average diameter of internal nuclei is from 0.1 to 5 mm, preferably from 0.2 to 4 mm, especially preferably from 0.3 to 3 mm. The thickness of each coating layer is from 0.01 to 5 mm, preferably from 0.05 to 2.5 mm, far preferably from 0.1 to 1.5 mm. And it is known that being high in number of coating layers, or the presence of three or more coating layers, makes larger contributions to reduction in hygroscopicity of granules and improvement in storage stability of granules than the thickness of each coating layer.

In the present reuse method of waste solutions, it is preferable that the regenerated solid processing agent is granulated in a way that the waste solution or solutions are once made into a solidified matter, ground into powder at one time, and then formed into granules with a granulator. The mode of granulation may be single-part granulation or a combination of core granulation and multilayer coating on the core. And these granulation modes can be performed in various processes. A wide variety of granulation processes are described in *Zouryu Handbook* (compiled by Nippon Funtai Kogyo Gijutu Kyokai, which is named "The Association of Powder Process Industry and Engineering, JAPAN" in English), and publications including JP-A-4-221951 and JP-A-2-109043. Of those processes, the following typical granulation processes are preferred. However, the processes usable in the invention should not be construed as being limited thereto.

(1) Rolling Granulation Process (*Zouryu Handbook*, Page 133)

A granulation process in which a solution (binder) is sprayed on to a feedstock powder while rolling the powder in a rotating container, such as a rotating drum or dish, and the powder is progressing rapidly with coalescence as the interfacial energy is used as an impetus to the coalescence, resulting in formation of granules.

(2) Compression Granulation Process (*Zouryu Handbook*, Page 199)

A process referred to as "briquette process" in which a feedstock powder undergoes molding granulation through compression and molding between two revolving rolls on the surfaces of which briquette pockets are carved, or a process referred to as "compacting process" in which a feedstock powder is formed into surface-smoothed platy flakes and then the flakes are crushed.

(3) Agitation Granulation Process (*Zouryu Handbook*, Page 379)

A process of performing granulation via coalescence, wherein a forced flow motion is given to a feedstock powder by use of agitation blades installed in a container as a solution is sprayed onto the powder, thereby causing coalescence.

(4) Extrusion Granulation Process (*Zouryu Handbook*, Page 169)

A process of granulating a feedstock by extrusion from pores of a die or screen. As an extrusion mechanism, a screw, roll, blade, self-forming or ram mechanism can be used.

(5) Crush Granulation Process (*Zouryu Handbook*, Page 349)

There are a dry process and a wet process. In a dry process, the briquettes or compact flakes obtained using the foregoing compression granulation process are crushed into granules, In a wet process, on the other hand, the powdery material is humidified in advance, then kneaded and further crushed into granule. In both processes, fragmentation by compression crushing is performed by application of impact with a hammer or shear with a cutter, or by use of a rough-toothed rolls or waveform rolls.

(6) Fluidized-bed Granulation Process (*Zouryu Handbook*, Page 349)

A granulation process involving an operation of spraying a powder with a binder while keeping the powder in a state of being suspended in a fluid blowing upward from the underside. Although this operation belongs to a unit operation referred to as fluidization, it is also possible to use a multifunctional fluidized-bed granulator in which this unit operation is combined with rolling and agitating actions.

(7) Coating Granulation Process (*Zouryu Handbook*, Page 409)

A granulation, process which involves forming particles bearing atomized solutions of coating substances and a binder on their individual core surfaces, and making the particles adhere to one another. Examples of a coating method usable therein include pan coating carried out under rolling with a rotating drum, rolling coating carried out under rolling with a rotating disk, fluidized-bed coating carried out forming a fluidized bed by airflow, and centrifugal flow coating carried out setting up a planetary motion by use of centrifugal force generated by rotation of a rotor and slit air.

(8) Fusion Granulation Process (*Zouryu Handbook*, Page 227)

A process of injecting a material in a fused state or dropping it onto a plate, thereby cooling and solidifying the fused material in the form of fine particles or flakes.

(9) Atomization-drying Granulation Process (*Zouryu Handbook*, Page 249 Page)

A granulation process which involves atomizing a solution, paste or suspension in hot-air stream on the inside of a drying tower and, at the same time, evaporating the moisture, thereby forming dried particles.

(10) Liquid-phase Granulation Process (*Zouryu Handbook*, Page 439)

A capsule granulation process known as a process of producing microcapsules. Specifically, an interfacial polymerization process, an in-solution cured coating process, an emulsion process, a contents exchange process and a spray drying process are known.

(11) Vacuum Freeze Granulation Process (*Zouryu Handbook*, Page 469)

A method of forming a granular matter from a moist material incapable of retaining a granule form at room temperature by utilizing frozen state (solidification by cooling).

In the invention, it is particularly advantageous to carry out the granulation of internal nuclei by the atomization-drying granulation process. And it is preferable that the coating on the internal nuclei is performed according to the rolling granulation process, the fluidized-bed granulation process or the coating granulation process. In particular, the coating granulation with a centrifugal flow-type coating machine is preferred because it can fully achieve the foregoing effects.

The granules formed may have water-soluble polymer coatings on their surfaces. The water-soluble polymer used for coating has no particular restriction as to its kind, but one or more polymers selected from synthetic, semi-synthetic or natural water-soluble macromolecular substances can be used. Examples of such macromolecular substances include gelatin, pectin, polyacrylic acid, polyacrylates, polyvinyl alcohol, modified polyvinyl alcohol, polyvinyl pyrrolidone, vinyl acetate copolymers, polyethylene glycol, sodium salt of carboxymethyl cellulose, hydroxypropylmethyl cellulose, hydroxyethyl cellulose, hydroxypropyl cellulose, methyl cellulose, ethyl cellulose, alginates, xanthan gum, gum arabic, tragacanth gum, karaya gum, carrageenan, and methyl vinyl ether-maleic anhydride copolymer. Of these polymers, polyethylene glycol, polyvinyl pyrrolidone, hydroxypropyl cellulose, methyl cellulose, gum arabic and carrageenan are preferably used alone or in combination of two or more thereof.

The amount of water-soluble polymer coated has no particular limitation as far as it is within the range of usual coatings. However, the suitable proportion of such a coating to each granule is from 0.001 to 10 mass %, preferably 0.01 to 5 mass %. As a method for coating water-soluble polymers, any methods can be used without particular restrictions. However, it is preferable to use the foregoing rolling, agitation, fluidized-bed, coating, fusion or atomization-drying granulation process. As to these processes, it is particularly advantageous to adopt a method of spray-coating the surface of each granule with an aqueous polymer solution having its concentration in the range of 1 to 50% in accordance with the rolling, fluidized-bed, coating or atomization granulation process, and then drying the polymer coating.

In the present method of reusing a waste solution, a granular processing agent container usable for the regenerated processing agent obtained by granulating a dry-solidified matter of the waste solution has a bag or bottle form, and its packaging material may be any of paper, plastic and metal. From the viewpoint of loads on the environment, bag-form containers made of paper or plastic films and bottle-form containers, especially those made of biodegradable plastics, are used to advantage. Examples of a biodegradable plastic usable therein include hydroxybutyrate-hydroxyvalerate copolymer, alipahtic polyester and polylactic acid. Further, barrier materials for packaging use are used to advantage from the viewpoint of various kinds of stability. In particular, plastic materials having oxygen permeability of 200 $mL/m^2 \cdot 24$ hrs·Pa or below are favorable. Additionally, the oxygen permeability coefficient can be determined by the method described in *$O_2$ Permeation of Plastic Container, Modern Packing*; N. J. Calyan, 1968, The December issue, pages 143–145. Examples of a plastic material suitable for packaging include polyvinylidene chloride (PVDC), nylon (NY), polyethylene (PE), polypropylene (PP), polyester (PES), ethylene-vinyl acetate copolymer (EVA), ethylene-vinyl alcohol copolymer (EVAL), polyacrylonitrile (PAN), polyvinyl alcohol (PVA) and polyethylene terephthalate (PET). For the purpose of reducing oxygen permeability, it is effective to use PVDC, NY, PE, EVA, EVAL and PET.

In using a packaging material for the granular processing agent, the material is molded into a specific form, such as the form of a film, a bag or a bottle. When a solid photographic processing agent is packaged in a barrier film, the film thickness adequate for protecting the processing agent from moisture is in the range of 10 to 150 $\mu$m. The barrier film suitable for such packaging use may be a simple material or a composite material made up of at least one or more materials selected from among polyethylene terephthalate film, polyolefin film such as polyethylene or polypropylene film, craft paper to which moisture resistance can be imparted by polyethylene, waxed paper, moisture-resistant cellophane, glassine, polyester film, polystyrene film, polyvinyl chloride film, vinylidene chloride-maleic acid copolymer film, polyvinylidene chloride film, polyamide film, polycarbonate film, acrylonitrile resin film, metal foil such as aluminum foil, and metallized polymer film.

High barrier (highly shielding) film packaging materials made of composite materials, such as (1) a composite of polyethylene terephthalate and low-density polyethylene, (2) a composite of vinylidene chloride-maleic acid copolymer-coated cellophane and low-density polyethylene, (3) a composite of polyethylene terephthalate, vinylidene chloride-maleic acid copolymer and low-density polyethylene, (4) a composite of nylon and low-density polyethylene, (5) a composite of low-density polyethylene, vinylidene chloride-maleic acid copolymer and low-density polyethylene, (6) a composite of nylon, Eparl and low-density polyethylene, (7) a composite of polyethylene terephthalate, Eparl and low-density polyethylene and (8) aluminum-evaporated polyethylene terephthalate, can be used to particular advantage from the viewpoints of high imperviousness to water, gas and light, ruggedness and flexible sealing capability. As these high-barrier packaging materials, the materials described in *Kinousei Housouzairyou no Shintenkai* (which might be translated "New Development of Functional Packging Materials), Toray Research Center (February, 1990), can be used.

The materials for the container having low oxygen permeability and low water-vapor permeability as disclosed in JP-A-63-17453, and the vacuum packaging materials disclosed in JP-A-4-19655 and JP-A-4-230748 can also be used as suitable container materials.

The granular processing agent to which the present method of reusing a waste solution is applied can be used in a mode of being loaded in an automatic developing machine as it is kept in a container and made available for photographic processing. The container suitably used in this case is a container made from, as a single constituent resin, high-density polyethylene (abbreviated as "HDPE" hereinafter) having a density of 0.941 to 0.969 and a melt index of 0.3 to 5.0 g/10 min. The preferable density of polyethylene used as the constituent resin is in the range of 0.951 to 0.969, especially in the range of 0.955 to 0.965, and the preferable melt index thereof is in the range of 0.3 to 4.0 g/10 min. These melt index values are values determined under a load of 2.16 kg at a temperature of 190° C. in accordance with the method defined in ASTM D1238. The suitable thickness of this container is from 500 to 1,500 $\mu$m. However, the containers for processing agents usable in the present system should not be construed as being limited to the foregoing HDPE containers convenient for loading in a developing machine, but other containers for general-purpose use, including the containers made from polyethylene terephthalate (PET), polyvinyl chloride (PVC), low-density polyethylene, and HDPE whose density and melt index are out of the aforementioned ranges, can also be used.

The descriptions of structures and preparation processes of granular processing agents are given above. Next, constituent chemicals of each processing agent usable in the present method of reusing a waste solution are illustrated. The solid processing agents regenerated by the present method of reusing waste solutions can be applied to any of processing agents for a bleaching bath, a fixing bath, a bleach-fix bath and, if necessary, a stabilizing bath, whether the processing agents are used for color photographic materials or black-and-white photographic materials, or whether the processing agents are used for picture-taking photographic materials or prints. In the case of gathering up the developer waste alone and solidifying it, the solid processing agent obtained can be used in the developer also.

Incidentally, as to the terms "development" and "development-processing" and the terms "developing agent" and "development-processing agent", there are a case of using them in a broad sense and a case of using them in a narrow sense. In the broad-sense case, the terms refer to a series of processing steps generally from a development step to a drying step and processing agents used for these steps. In the narrow-sense case, on the other hand, the terms refer to a development step alone and a processing agent for the development step. When whether those terms used in this specification admit of wide interpretation or narrow interpretation is obscure even from the context, the terms "processing" and "processing agent" are used for wide interpretation, and the terms "development" and "development-processing agent" are used for narrow interpretation.

The constituents of a color developing agent (including a developing agent, a regenerated developing agent and a developing solution) used in the present method of reusing a waste solution are described to begin with. Preferred examples of a color developing agent include known aromatic primary amine color developing agents, especially p-phenylenediamine derivatives. Representatives thereof are recited below. However, these representative compounds should not be construed as limiting the scope of color developing agents usable in the invention.

1) N,N-diethyl-p-phenylenediamine
2) 4-Amino-N,N-diethyl-3-methylaniline
3) 4-Amino-N-(β-hydroxyethyl)-N-methylaniline
4) 4-Amino-N-ethyl-N-(β-hydroxyethyl)aniline
5) 4-Amino-N-ethyl-N-(β-hydroxyethyl)-3-methylaniline
6) 4-Amino-N-ethyl-N-(3-hydroxypropyl)-3-methylaniline
7) 4-Amino-N-ethyl-N-(4-hydroxybutyl)-3-methyl aniline
8) 4-Amino-N-ethyl-N-(β-methanesulfonamidoethyl)-3-methyl-aniline
9) 4-Amino-N,N-diethyl-3-(β-hydroxyethyl)aniline
10) 4-Amino-N-ethyl-N-(β-methoxyethyl)-3-methylaniline
11) 4-Amino-N-(β-ethoxyethyl)-N-ethyl-3-methylaniline
12) 4-Amino-N-(3-carbamoylpropyl)-N-n-propyl-3-methyl-aniline
13) 4-Amino-N-(4-carbamoylbutyl)-N-n-propyl-3-methylaniline
14) N-(4-Amino-3-methylphenyl)-3-hydroxypyrrolidine
15) N-(4-Amino-3-methylphenyl)-3-(hydroxymethyl) pyrrolidine
16) N-(4-Amino-3-methylphenyl)-3-pyrrolidine carboxamide Of the p-phenylenediamine derivatives recited above, Compounds 5), 6), 7), 8) and 12) are preferred over the others. In particular, Compounds 5) and 8) are advantageous. In general these p-phenylenediamine derivatives each take the form of a salt, such as sulfate, hydrochloride, sulfite, naphthalenesulfonate or p-toluenesulfonate, when they are in a solid matter state. In using the granulated processing agent composition, it is mixed with an established proportion of water and formed into a working solution such as a developer or a replenisher for developer (Hereinafter, these working solutions are both referred to as a developer unless it has a particular significance to make a distinction between the developer and the replenisher for developer. Similarly thereto, the developing agent and the replenishing agent for developing agent are both referred to as developing agent.). As to the content of an aromatic primary amine developing agent in a processing agent, the developing agent is added to a working solution in such a concentration as to make its amount per liter of developer fall within the range of 2 to 200 millimoles, preferably 6 to 100 millimoles, particularly preferably 10 to 40 millimoles.

Depending on the type of photosensitive materials to be developed, there are cases where the color developing agent contains a small amount of sulfite ion, or in other cases, substantially no sulfite ion is contained in the color developing agent. In the invention, however, it is preferable to add a small amount of sulfite ion to the color developing agent. The sulfite ion has remarkable preservative action, but there may be cases where the sulfite ion present in excessive amounts exerts undesirable influences on photographic properties at the step of color development. In addition, the color developing agent may contain a small amount of hydroxylamine. When the hydroxylamine (which is generally used in the form of hydrochloride or sulfate, but the salt form is omitted hereinafter) is contained, it functions as a preservative of the developer as with the sulfite ion. As the hydroxylamine is apt to exert undesirable influences on photographic characteristics because of its own silver-development activity, the addition amount thereof is required to be small.

To the color developing agent, organic preservatives may be added as well as the aforementioned hydroxylamine and sulfite ion. The term "organic preservatives" as used herein refers to all of the organic compounds capable of reducing a deterioration speed of an aromatic primary amine color developing agent when incorporated in the solution for processing photosensitive materials. Specifically, they are organic compounds having the function of preventing air oxidation of the color developing agent. Especially effective organic preservatives include not only the hydroxylamine derivatives as recited above but also hydroxamic acids, hydrazides, phenols, α-hydroxyketones, α-aminoketones, sugars, monoamines, diamines, polyamines, quaternary ammonium salts, nitroxy radicals, alcohols, oximes, diamide compounds and condensed-ring amines. These organic preservatives are disclosed in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, JP-A-52-143030, and JP-B-48-30496.

As other preservatives, the various metals disclosed in JP-A-57-44148 and JP-A-57-53749, the salicylic acids disclosed in JP-A-59-180588, the alkanolamines disclosed in JP-A-54-3532, the polyethyleneimines disclosed in JP-A-56-94349 and the aromatic polyhydroxy compounds disclosed in U.S. Pat. No. 3,746,544 may be added, if needed. In particular, alkanolamines, such as triethanolamine and triisopropanolamine, substituted or unsubstituted dialkylhydroxylamines, such as disulfoethylhydroxylamine and diethylhydroxylamine, or aromatic polyhydroxy compounds may be added. Of those organic preservatives, the hydroxylamine derivatives are described in detail in JP-A-1-97953, JP-A-1-186939, JP-A-1-186940 and JP-A-1-187557. The addition of hydroxylamine derivatives in combination with amines in particular is also effective from the viewpoint of enhancing stability of a color developer and consistency during the continuous processing. Examples of such amines include the cyclic amines as disclosed in JP-A-63-239447, the amines as disclosed in JP-A-63-128340, and the amines as disclosed in JP-A-1-186939 and JP-A-1-187557. The appropriate proportion of preservatives in the processing agent depends on the species of the preservatives. In general, the preservatives are added to a working solution so as to have a concentration that their amount per liter of developer fall within the range of 1 to 200 millimoles, preferably from 10 to 100 millimoles.

To a color developer, such as a developer for color paper, chloride ion may be added when required. In many of usual cases, the chloride ion concentrations in color developers (especially developers for color print materials) are within the range of $3.5\times10^{-2}$ to $1.5\times10^{-1}$ mole/liter. However, there are also many cases where the addition of chloride ion to a developing agent for replenishment is unnecessary, because chloride ion is generally released into a developer as a by-product of development. For instance, developing agents used for photosensitive materials of picture-taking type need not contain chloride ion.

As to the bromide ion, the suitable bromide ion concentration in a color developer is of the order of $1–5\times10^{-3}$ mole/liter in the processing of photosensitive materials of picture-taking type, while it is not greater than $1.0\times10^{-3}$ mole/liter in the processing of print materials. However, as with chloride ion, the addition of bromide ion to a color developer is unnecessary in many cases. In the case where the addition of bromide ion is required, however, bromide ion can be added to a processing agent so that the bromide ion concentration falls within the aforementioned range. In the cases where silver iodobromide emulsions constitute the photosensitive materials to be processed, such as the cases of color negative films and color reversal films, the appropriate concentration of iodide ion is in the same situation as those of chloride and bromide ions. In general, the iodide ion concentration becomes 0.5 to 10 mg/liter of developer as a result of iodide ion release from the photosensitive materials. Therefore, it is usual that no iodide ion is contained in a processing agent for replenishment.

In the cases of using halides as additive ingredients in a developing agent and a developer replenishing agent, materials usable for providing chloride ions include sodium chloride, potassium chloride, ammonium chloride, lithium chloride, nickel chloride, magnesium chloride, manganese chloride and calcium chloride. Of these chlorides, sodium chloride and potassium chloride are used to advantage. Examples of materials usable for providing bromide ions include sodium bromide, potassium bromide, ammonium bromide, lithium bromide, calcium bromide, magnesium bromide, manganese bromide, nickel bromide, cerium bromide and thallium bromide. Of these bromides, potassium bromide and sodium bromide are preferred over the others. As a material for providing iodide ion, sodium iodide or potassium iodide is used.

In the invention, it is appropriate that the developer and the replenisher be both adjusted to pH 9.0–13.5. Therefore, alkali agents, pH buffers and, if needed, acid agents can be incorporated in each of the developing agent and the replenishing agent in amounts required for keeping the pH values of those processing solutions within the foregoing range. To the internal nucleus of a granular processing agent, hydroxides of every kind can be added as alkalis. Specifically, potassium hydroxide, sodium hydroxide, lithium hydroxide, tripotassium hydrogen phosphate, trisodium hydrogen phosphate and their hydrates can be added as hydroxides. On the other hand, a liquid chemical part is provided as a composition separated from the granular agent, and thereto triethanolamine or diethanolamine may be added. As the acids added when required, water-soluble, solid-state inorganic or organic acids can be used. Examples of such acid include succinic acid, tartaric acid, propionic acid and ascorbic acid.

In order to let each processing solution have its pH within the range specified above at the time when it is prepared, it is preferable to use various kinds of buffering agents. The buffering agents usable herein include carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts and lycine salts. In particular, phosphates, tetraborates and hydroxybenzoates are preferred as buffering agents over the other salts, because these salts possess advantages that they have excellent buffering capability in the high pH range of 9.0 or above, exert no bad influences (e.g., fogging) on photographic properties when added to color developers, and are inexpensive.

Examples of these buffering agents include sodium carbonate, potassium carbonate, sodium hydrogen carbonate, potassium hydrogen carbonate, trisodium phosphate, tripotassium phosphate, disodium hydrogen phosphate, dipotassium hydrogen phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the buffering agents usable in the invention should not be construed as being limited to these compounds. As the buffering agents are not ingredients of the type which are consumed by undergoing reaction, the amounts of the buffering agent added to compositions are determined so that their concentration in each of a developer and a replenisher prepared from the processing agent is within the range of 0.01 to 2 moles per liter, preferably 0.1 to 0.5 mole, per liter.

To a color developer can be added various kinds of chelating agents capable of functioning so as to inhibit precipitation of other ingredients of a color developer, such as calcium and magnesium, or enhance color developer stability. Examples of chelating agents include nitrilotriacetic acid, diethylenetriaminepentaacetic acid, ethylenediaminetetraacetic acid, N,N,N-trimethylenephoshonic acid, ethylenediamine-N,N,N',N'-tetramethylenesulfonic acid, trans-cyclohexanediaminetetraacetic acid, 1,2-diaminopropanetetraacetic acid, glycoletherdiaminetetraacetic acid, ethylenediamine-o-hydroxyphenylacetic acid, ethylenediaminedisuccinic acid (SS body), N-(2-carboxylatoethyl)-L-aspartic acid, β-alaninediacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, and 1,2-dihydroxybenzene-4,6-disulfonic acid. Two or more of these chelating agents may be used in combination, if needed. It may be good to add these chelating agents in an amount enough to block metal ions in a color developer prepared. For instance, they are added in an amount to ensure the concentration of the order of 0.1–10 g per liter.

To the color developing agent used in the invention, any of known development accelerators may be added, if needed. For instance, the thioether compounds as disclosed in JP-A-37-16088, JP-A-37-5987, JP-A-38-7826, JP-A-44-12380, JP-A-45-9019 and U.S. Pat. No. 3,813,247, the p-phenylenediamine compounds as disclosed in JP-A-52-49829 and JP-A-50-15554, the quaternary ammonium salts as disclosed in JP-A-50-137726, JP-A-44-30074, JP-A-56-156826 and JP-A-52-43429, the amine compounds as disclosed in U.S. Pat. Nos. 2,494,903, 3,128,182, 4,230,796 and 3,253,919, JP-A-44-11431, and U.S. Pat. Nos. 2,482,546, 2,596,926 and 3,582,346, the polyalkylene oxides as described in JP-A-37-16088 and JP-A-42-25201, U.S. Pat. No. 3,128,183, JP-A-41-11431, JP-A-42-23883 and U.S. Pat. No. 3,532,501, 1-phenyl-3-pyrazolidones or imidazoles can be added as development accelerators, if needed. The amounts of these development accelerators added to compositions are determined so that their concentration in each of the developer and the replenisher prepared from the processing agent is in the range of 0.001 to 0.2 mole/liter, preferably 0.01 to 0.05 mole/liter.

To the color developer used in the invention, any of known antifoggants, other than halide ions as described above, can be added, if needed. Typical examples of an organic antifoggant usable herein include nitrogen-containing heterocyclic compounds, such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethyl-benzimidazole, indazole, hydroxyazaindolizine and adenine. Further, various types of surfactants, such as alkylsulfonic acids, arylsulfonic acids, aliphatic carboxylic acids and aromatic carboxylic acids, may be added to the color developer used in the invention, if desired. The amounts of surfactants added to compositions are determined so that their concentration in each of the developer and the replenisher prepared from the processing agent is in the range of 0.001 to 0.2 mole/liter, preferably 0.01 to 0.05 mole/liter.

Next, the composition of a black-and-white developing agent (including a developing agent, a regenerated developing agent and a developer) is described. In the black-and-white developing agent, any of known developing agents can be used. More specifically, dihydroxybenzenes (e.g., hydroquinone, hydroquinone monosulfonate, catechol), 3-pyrazolidones (e.g., 1-phenyl-3-pyrazolidone, 1-phenyl-4-methyl-4-bydroxymethyl-3-pyrazolidone, 1-phenyl-4,4-dihydroxymethyl-3-pyrazolidone), amidophenols (e.g., N-methyl-p-aminophenol, N-methyl-3-methyl-p-aminophenol, N-methyl-2-sulfoamino-aminophenol), ascorbic acid and erysorbic acid and their isomers and derivative, and the p-phenylenediamines recited above as color developing agents can be used alone or as combinations of two or more thereof. When these developing agents are used in the form of salts, their counter part to form salts can be sulfate, hydrochloride, phosphate or p-toluenesulfonate. It is preferable to add these developing agent in an amount of $1\times10^{-5}$ to 2 moles per liter of developer prepared.

In the black-and-white developing agent, preservatives can be used, if needed. In general, sulfites or hydrogen sulfites are used as preservatives. These preservatives are added in an amount that their concentration in the developer prepared is from 0.01 to 1 mole per liter, preferably from 0.1 to 0.5 mole per liter. In addition, ascorbic acid also is an effective preservative, and it is preferable to add ascorbic acid in an amount that its concentration in the developer prepared is in the range of 0.01 to 0.5 mole per liter. Further, hydroxylamines, saccharides, o-hydroxyketones and hydrazines can also be used. These compounds are added in an amount that their concentration in the developer prepared is from 0.002 to 1.0 mole per liter.

The suitable pH of the black-and-white developer is from 8 to 13, particularly preferably from 9 to 12. In order to retain such a pH value, various alkali agents and buffering agents, and further acid agents, if needed, are added to a development-processing agent. Suitable examples of alkali agents, buffering agents and acid agents include the compounds already recited in the description of color developing agents. In addition to such compounds, hydroxybenzoates, glycine salts, N,N-dimethylglycine salts, leucine salts, norleucine salts, guanine salts, 3,4-dihydroxyphenylalanine salts, alanine salts, aminobutyrates, valine salts and lycine salts can be used as buffering agents. In these buffering agents, the counter part to form the salts thereof can be an alkali metal, such as Na or K, or ammonium. These buffering agents may be used alone.

In the black-and-white developing agent also, silver halide solvents may be contained as development accelerators. Examples of a development accelerator usable herein include thiocyanates, sulfites, thiosulfates, 2-methylimidazole, various quaternary amines, polyethylene oxides, 1-phenyl-3-pyrazolidones, primary amines, N,N,N',N'-tetramethyl-p-phenylenediamine, the thioether compounds disclosed in JP-A-57-63580, and the accelerators recited in the above description of color developing agents. The suitable concentration of these accelerators in a developer (a replenisher of developer) prepared is of the order of 0.005–0.5 mole/l.

For the purpose of developer fog prevention, various antifoggants as recited in the above description of color developers may be added also to the granular black-and-white developing agent relating to the invention.

Further, swell inhibitors (e.g., inorganic salts, such as sodium sulfate and potassium sulfate) and water softeners can be added to the black-and-white developing agent relating to the invention. In addition, the black-and-white developing agent may contain various chelating agents and surfactants as recited in the above description of color developers in their respective concentrations on the same levels as those in color developers, if desired.

In describing processing agents for the desilvering step, as in the case of the developing step, processing baths, regenerated processing agents and new processing agents are bracketed in the group of "processing agents". To begin with, bleaching agents used for a bleaching bath and a bleach-fix bath in the color photographic processing are described. Although any of known bleaching agents can be used in a bleaching bath and a bleach-fix bath, organic complex salts of Fe(III) (e.g., Fe(III) complex salts of aminopolycarboxylic acids), organic acids such as citric acid, tartaric acid and malic acid, persulfates and hydrogen peroxide are used to particular advantage.

Of these bleaching agents, organic complex salts of Fe(III) are preferred in particular from the viewpoints of rapid processing and prevention of environmental pollution. Examples of amino polycarboxylic acids useful for forming organic complex salts of Fe(III) and salts thereof include not only biodegradable aminopolycarboxylic acids, such as ethylenediaminedisuccinic acid (SS body), N-(2-caboxylatoethyl)-L-aspartic acid, β-alaninediacetic acid and methyliminodiacetic acid, but also ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, iminodiacetic acid and glycoletherdiaminetetraacetic acid. The salts formed from these acids may be any of sodium, potassium, lithium and ammonium salts. Of those acids, ethylenediaminedisuccinic acid (SS body), N-(2-carboxylatoethyl)-L-aspartic acid, β-alaninediacetic acid, ethylenediaminetetraacetic acid, 1,3-diaminopropanetetraacetic acid and methyliminodiacetic acid are preferred over the others because their Fe(III) complex salts can ensure good photographic properties. These complex salts of ferric ion may be used in the complex salt form itself, or they may be formed in a solution by use of ferric salts, such as ferric sulfate, ferric chloride, ferric nitrate, ammonium ferric sulfate and ferric phosphate, and chelating agents such as aminopolycarboxylic acids. Further, the chelating agents may be added in excess of an amount required for forming ferric ion complex salts. Of iron complex salts, aminopolycarboxylic acid-iron complex salts are preferred over the others.

The addition amount of a bleaching agent is determined so that the processing solution prepared has a bleaching agent concentration of 0.01 to 1.0 mole/liter, preferably 0.03 to 0.80 mole/liter, far preferably 0.05 to 0.70 mole/liter, particularly preferably 0.07 to 0.50 mole/liter.

It is appropriate that the bleaching agent, the bleach-fix bath or a fixing bath contain a wide variety of known organic acids (e.g., glycolic acid, succinic acid, maleic acid, malonic acid, citric acid, sulfosuccinic acid), organic bases (e.g., imidazole, dimethylimidazole), the compounds represented by formula (A-a) disclosed in JP-A-9-211819, including 2-picolinic acid, and the compounds represented by formula (B-b) disclosed in the same patent document as cited above, including kojic acid. The suitable addition amount of such compounds is determined so that the concentration thereof in a processing solution prepared falls within the range of 0.005 to 3.0 mole/liter, preferably 0.05 to 1.5 mole/liter.

Next, fixing agents for color processing and black-and-white processing (including fixing agents of a bleach-fix bath for color photography) are described collectively. The compounds used as these fixing agents are known fixing chemicals, namely water-soluble silver halide solvents, such as thiosulfates including sodium thiosulfate and ammonium thiosulfate, thiocyanates including sodium thiocyanate and ammonium thiocyanate, thioether compounds including ethylenebisthioglycolic acid and 3,6-dithia-1,8-octanediol, and thioureas. These compounds can be used alone or as mixtures of two or more thereof. On the other hand, a special bleach-fix bath containing a combination of the fixing agent as disclosed in JP-A-55-155354 and a large amount of halide, such as potassium iodide, can also be employed. In the invention, the use of thiosulfates, especially ammonium thiosulfate is advantageous. The suitable concentration of fixing chemicals in each of fixing and bleach-fix baths prepared from granular processing agents is from 0.3 to 3 mol/l, preferably 0.5 to 2.0 mol/l.

The suitable pH range at the time when fixing agents are dissolved in each of bleach-fix and fixing baths used in the invention is from 3 to 8, preferably from 4 to 8. When the pH is lower than the foregoing range, the desilvering capability is increased, but deterioration of the baths and conversion of cyan dyes into leuco compounds thereof are accelerated. When the pH is higher than the foregoing range, on the other hand, the desilvering is retarded and stains are liable to develop. The pH range of a bleaching bath prepared from the granular agent usable in the present system is Borbelow, preferably from 2 to 7, particularly preferably from 2 to 6. When the pH is lower than the foregoing lower limit, deterioration of the bath and conversion of cyan dyes into leuco compounds thereof are accelerated. When the pH is higher than the foregoing upper limit, on the other hand, desilvering is retarded and stains are liable to develop. For the pH adjustment, the solid-state acids as recited above, the solid-state alkalis as recited above, such as potassium hydroxide, sodium hydroxide, lithium hydroxide, lithium carbonate, sodium carbonate and potassium carbonate, and acidic or alkaline buffers can be added on an as needed basis.

The bleach-fix bath can further contain various other additives, such as a brightening agent, an antifoaming agent or a surfactant, and polyvinyl pyrrolidone. Additionally, it is also permitted to incorporate the brightening agent in the developing solution prepared into a color developer so as to have a concentration of 0.02 to 1.0 mol/liter. It is appropriate that the bleach-fix bath and the fixing bath contain as preservatives sulfite ion-releasing compounds, such as sulfites (e.g., sodium sulfite, potassium sulfite, ammonium sulfite), hydrogen sulfites (e.g., ammonium hydrogen sulfite, sodium hydrogen sulfite, potassium hydrogen sulfite) and metabisulfites (e.g., potassium metabisulfite, sodium metabisulfite, ammonium metabisulfite), and arylsulfinic acids, such as p-toluenesulfinic acid and m-carboxybenzenesulfinic acid. The suitable concentration of these compounds is from about 0.02 to about 1.0 mol/l, based on sulfite ions or sulfinate ions.

In addition to the preservatives as recited above, ascorbic acid, carbonyl-hydrogen sulfite adducts or carbonyl compounds may be added as preservatives.

After the conclusion of fixation or bleach-fixation, processing with a stabilizing bath as a washing substitute or a stabilizing bath for image stabilization is performed in many cases. These baths are low in concentration, so the granular processing agent does not have much effect. However, granulated processing agents can be prepared from such baths, if desired. To the processing agent for a stabilizing bath, the method of reducing calcium and magnesium ions as disclosed in JP-A-62-288838 can be applied very effectively. In addition, it is possible to use in the stabilizing bath the isothiazolone compounds and thiabendazoles disclosed in JP-A-57-8542, the chlorine-containing bactericides, such as sodium salt of chlorinated isocyanuric acid disclosed in JP-A-61-120145, the benzotriazoles disclosed in JP-A-61-267761, copper ion, and other bactericides as described in Hiroshi Horiguchi, *Bohkin Bohbai no Kagaku* (which means "Antibacterial and Mold-proof Chemistry"), Sankyo Shuppan (1986); *Biseibutsuno Mekkin Sakkin Bohbai Gijutsu* (which means "Arts of Sterilizing and Pasteurizing Microbes, and Proofing Against Molds"), compiled by Eisei Gijutsukai, published by Kogyo Gijutsu Kai in 1982; and Bohkin-Bohbaizai Jiten (which means "Encyclopedia of Anti-bacteria and Anti-molds"), compiled by Nippon Bohkin Bohbai Gakkai.

Further, aldehydes including formaldehyde, acetoaldehyde and pyruvaldehyde, the methylol compounds and the hexamethylenetetramines disclosed in U.S. Pat. No. 4,786,583, the hexahydrotriazines disclosed in JP-A-2-153348, the formaldehyde-hydrogen sulfite adducts disclosed in U.S. Pat. No. 4,921,779, and the azolylmethylamines disclosed in EP-A-504609 and EP-A-519190 may be added in order to prevent discoloration of dyes and development of stains by deactivation of residual magenta couplers. Furthermore, surfactants as agents for draining water off and chelating agents represented by EDTA as water softening agent can also be used.

Up to this point, the description of constituents of processing agents used in the present system is concluded. Next, the processing steps performed using the processing agents in the present system are described. In the case of color photographic materials, the photographic processing to which the invention is applicable includes a color development step, a desilvering step, a washing step or a step of using a stabilizing bath, and a drying step. Further, an auxiliary step, such as a rinsing step, an intermediate washing step or a neutralizing step, may also be inserted in each individual interval between two successive steps. The desilvering processing is effected by one-step processing with a bleach-fix solution or two-step processing constituted of a bleaching step and a fixing step. In addition to the stabilizing bath as a washing step substitute, a processing bath for image stabilization can be inserted between the washing step or the step with a stabilizing bath as a washing substitute and the drying step. In the case of black-and-white photographic materials, the photographic processing include a developing step, a fixing step, a washing step and a drying step, and an auxiliary step, such as an intermediate washing step including rinsing, or a neutralizing step, can also be inserted in each individual interval between two successive steps. The processing method adopted in the invention may be any of processing methods of rapid development type, low replenishment rate type and internationally compatible standard type.

Each of the color and black-and-white development steps is an immersion-in-bath processing step in which photosensitive materials are immersed in a developing bath, and the developing bath is an alkaline continuous-phase liquid containing its ingredients in a dissolved state. A developer and a replenisher for the developer are prepared and used in a development tank and a replenishment tank, respectively.

When the photosensitive materials to undergo development-processing are color picture-taking materials, such as color negative and color reversal films, the processing temperature is from 30° C. to 40° C. in general cases, while in the rapid-processing cases the processing temperature is in the range of 38 to 65° C., preferably 40 to 55° C. The development-processing time is from 1 to 8 minutes in general cases, while in the rapid-processing cases the processing time is in the range of 15 to 195 seconds, preferably 20 to 150 seconds. The replenishment rate is 600 milliliter per $m^2$ of photosensitive material in the standard development, while in the processing at a low replenishment rate the replenishment volume per $m^2$ of photosensitive material is from 30 to 390 milliliter, preferably from 50 to 300 milliliter, and in some special cases it may be from 80 to 200 milliliter. When the photosensitive materials to undergo development-processing are color print materials such as color photographic paper, the processing temperature is from 30° C. to 40° C. in general cases, while in the rapid-processing cases the processing temperature is in the range of 38 to 65° C. The development-processing time is from 30 seconds to 3 minutes in general cases, while in the rapid-processing cases the processing time is in the range of 5 to 45 seconds, preferably 5 to 20 seconds. The replenishment rate is 161 milliliter per $m^2$ of photosensitive material in the standard development, while in the processing at a low replenishment rate the replenishment volume per $m^2$ of photosensitive material is from 10 to 150 milliliter, preferably from 20 to 100 milliliter, and in certain cases the replenishment volume may be in the range of 25 to 80 milliliter. The temperature and the processing time at the step of developing black-and-white materials for picture-taking and printing are in the same ranges as those in the color development.

In the color photographic processing, photosensitive materials are conducted into the desilvering step subsequently to the development-processing step, and processed with a bleaching bath and a bleach-fix bath. The bleach time is generally from 10 seconds to 6 minutes and 30 seconds, preferably from 10 seconds to 4 minutes and 30 seconds, particularly preferably from 15 seconds to 2 minutes. The processing time of bleach-fix processing according to the invention is from 5 to 240 seconds, preferably from 10 to 60 seconds. The processing temperature is in the range of 25° C. to 60° C., preferably 30° C. to 50° C. The replenishment rate is from 10 ml to 250 ml, preferably from 10 ml to 100 ml, particularly preferably from 15 ml to 60 ml, per $m^2$ of photosensitive material. In the black-and-white development processing, the processing with a fixing bath is performed subsequently to the development step. The processing time in the fixation processing is from 5 to 240 seconds, preferably from 10 to 60 seconds, and the processing temperature is from 25 to 60° C., preferably from 30 to 50° C. And the replenishment rate is from 20 to 250 ml, preferably from 30 to 100 ml, particularly preferably from 15 to 60 ml, per $m^2$ of photosensitive material.

In general, wash or stabilizing bath processing is carried out after the desilvering processing in the case of color photographic materials, while wash processing is carried out after the fixation processing in the case of black-and-white photographic materials. The volume of washing water used in the wash processing can be selected from a wide range depending on the characteristics (e.g., properties of constituents used, including couplers) and uses of photosensitive materials to undergo the processing, the washing temperature, the number of wash tanks used (the number of stages) and various other conditions. The relation between the number of wash tanks and the water volume in the multi-stage counter-current system can be determined by the method described in *Journal of the Society of Motion Picture and Television Engineers*, vol. 64, pp. 248–253 (May, 1955). The suitable number of stages in the multi-stage counter current system is generally from 3 to 15, preferably 3 to 10.

The multi-stage counter-current system enables a significant reduction in the volume of wash water, but causes a problem that a scum formed by propagation of bacteria resulting from an increase in staying time of water in the wash tank adheres to photosensitive materials processed therein. As a solution of this problem, the use of a stabilizing bath containing antibacterial and antimold agents is preferred.

The suitable pH in the wash step or the stabilization step is from 4 to 10, preferably from 5 to 8. The temperature therein, though can be set variously depending on the uses and characteristics of photosensitive materials, can be set generally within the range of 20 to 50° C., preferably within the range of 25 to 45° C. Subsequently to the wash and/or stabilization step, drying is carried out. From the viewpoint of reduction in quantity of water brought in the image-formed layers, it is also possible to absorb the water brought in by use of squeegee rollers or cloth and thereby to expedite the drying step. For improvement in drying efficiency on the side of a dryer, as a matter of course, it is possible to increase a drying speed by raising a drying temperature or modifying the shape of blowing nozzles to increase the blowing strength of a drying air. Further, as disclosed in JP-A-3-157650, the drying speed can also be increased by making an adjustment to the blowing angle of drying air with respect to photosensitive materials and devising a removal method of drying-air emission.

Up to this point we have described the photographic processing method using granular processing agents in the present system. Next the processing apparatus performing the photographic processing method is illustrated.

The photographic processing method relating to the invention is carried out by use of an automatic processor. The automatic processor preferably used in the invention is described below.

It is appropriate in the invention that the linear transport speed of in the automatic processor be 5,000 mm/min or below, preferably from 200 mm/min to 4,500 mm/min, particularly preferably from 500 to 3,000 mm/min. When the processing solutions relating to the invention are in a state that they are placed in processing tanks and replenisher tanks, it is advantageous for them to have the smallest possible contacted areas with air (opening area). For instance, taking the value obtained by dividing the opening area ($cm^2$) by the volume ($cm^3$) of a processing solution placed in a tank as an opening rate, the appropriate opening rate is 0.01 ($cm^{-1}$) or below, preferably 0.005 or below, particularly preferably 0.001 or below.

In order to reduce the contacted area with air, it is preferable to float a solid or liquid means for avoiding contact with air on the surface of a solution placed in a processing tank or a replenisher tank. Specifically, it is preferable to float a plastic-made float on the surface of a solution or cover the surface of a solution with a liquid having no compatibility and causing no chemical reaction. Suitable examples of such a liquid include liquid paraffin and liquid saturated hydrocarbons.

The shorter the aerial passage time required for a photosensitive material to move from each processing bath to its adjacent processing bath, namely the crossover time, the more favorable the condition becomes for performing rapid processing in the invention. The suitable crossover time is 10 seconds or below, preferably 7 seconds or below, far preferably 5 seconds or below. For achieving such a short crossover time in the invention, it is preferable to use a motion picture film-processing machine, especially adopting a leader transport system. Such a system is used in an automatic developing machine, FP-560B (trade name, made by Fuji Photo Film Co., Ltd.). For transporting leaders and photosensitive materials, it is preferable to adopt the belt conveyance systems disclosed in JP-A-60-191257, JP-A-60-191258 and JP-A-60-191259. Further, the structure of a crossover rack equipped with anti-mixing plates is favorable for reduction of a crossover time and prevention of mixing with processing solutions.

In the invention, it is appropriate to supply each processing bath with the same amount of water as lost from the processing bath by evaporation, or to make an evaporation correction to each processing bath. This correction is particularly effective on a color developer and a bleaching or bleach-fix bath. There is no particular restriction as to the method for replenishing each processing bath with water, but it is preferable to adopt the methods disclosed in JP-A-1-254959 and JP-A-1-254960, wherein a monitoring water tank is installed aside from a bleach tank, the amount of water evaporating from the monitoring water tank is determined, and from the thus determined amount of evaporated water the amount of water evaporating from the bleach tank is calculated and the bleach tank is replenished with water in an amount proportion to the calculated amount of evaporation; and evaporation correction methods using a level sensor and an overflow sensor. The most advantageous method for evaporation correction is a method of adding water in the likely amount of water evaporation, and more specifically, a method of adding water in the amount calculated from factors previously determined on the basis of information about the operation time, the stoppage time and the temperature control time of an automatic developing machine, as disclosed in *Koukai Giho* (translated in English, it means "Journal of Technical Disclosure"), Kougi No. 94-49925, page 1, right column, line 26, to page 3, left column, line 28, issued by Hatsumei Kyokai (Japan Institute of Invention and Innovation (JIII).

In addition, it is required to devise a reduction in evaporation, and a reduction in opening area and a control of the air quantity of a ventilation fan are needed. For instance, the opening rate suitable for the color developer is mentioned above, and it is preferable to reduce opening areas of other processing baths as is the case with the color developer. As a method of reducing the amount of water evaporation, "keeping the top space humidity of a processing tank at 80% RH or higher" as disclosed in JP-A-6-10171 is especially preferred, and what is more, provision of the evaporation inhibiting rack and the automatic roller cleaning mechanism shown in FIGS. 1 and 2 of the patent document cited above is advantageous in particular. Further, a ventilation fan for prevention of condensation at the time of temperature control is generally installed. Moreover, the conditions for drying photosensitive materials have influences also on evaporation of processing baths. As a drying method, it is preferable to use a ceramic warm-air heater. The suitable quantity of air supplied is from 4 to 20 $m^3$ per minute, preferably from 6 to 10 $m^3$ per minute. The operation of a thermostat for preventing the ceramic warm-air heater from overheating is preferably effected by thermal conduction. As to the position of the thermostat attached, it is appropriate to attach the thermostat upwind or downwind via heat dissipating fins or a heat-transfer section. The drying temperature is preferably adjusted depending on the water content in the photosensitive material processed. In general, the optimal drying temperature is from 45 to 55° C. in the case of APS-format films and 35 mm-wide films, while it is from 55 to 65° C. in the case of Blownie films. At the time of replenishment of processing baths, a replenishment pump, preferably a bellows replenishment pump, is used. For improving the replenishment accuracy, it is effective to design tubes for feeding a solution into replenishment nozzles so as to have small diameters and prevent a backflow of the solution when the pump stops.

The suitable drying time is from 5 seconds to 2 minutes, preferably from 5 seconds to 60 seconds. Up to this point, continuous processing according to a replenishment method is mainly described. In the invention, however, it is possible to adopt the so-called throwaway processing method in which the processing is carried out using fixed amounts of processing solutions without undergoing any replenishment in not only the developing step but also the steps subsequent thereto, and after a set period of time all or part of the processing solutions are replaced by new ones and the processing is resumed.

In the present system may be adopted a mode of supplying the granular processing agent as a granular composition made up of single or multiple parts directly to an automatic developing machine, or a mode of dissolving the granular processing agent to prepare a replenisher, once storing the replenisher in a replenishment tank and then supplying the replenisher while performing replenishment control.

In addition, it is also preferable to adopt a mode of loading a bottle containing a granular processing agent in a developing machine in a condition that the bottle cap is turned upside down, opening the cap, throwing the contents (granules) into a replenishment tank and dissolving them with water in the replenishment tank. As the water for dissolving the granules, the water in a wash-water replenishment tank is used to advantage. In another adoptable mode, the processing tank is replenished directly with granules and water in the amount matching the dilution rate. To a compact developing machine having no replenishment tank in particular, this replenishing mode is favorable.

In the case of the granular processing agent made up of multiple parts, it is possible similarly to the above to load each part on the top of a replenishment tank in a developing machine, and dissolving granular ingredients constituting each part automatically with water in the replenishment tank. As the water for dissolving the granules, the water in a wash-water replenishment tank is used to advantage. In another adoptable mode, the processing tank is replenished directly with granules of each part and water in the amount matching the dilution rate.

In order to reduce dust adhesion to a magnetic recording layer coated on a photosensitive material, the stabilizer disclosed in JP-A-6-289559 is used to advantage. To the present granular processing agents, the processing specifications disclosed in *Kohkai Giho* (Journal of Technical Disclosure), Kougi No. 94-4992, page 3, right column, line 15, to page 4, left column, line 32, issued by Hatsumei Kyokai (Japan Institute of Invention and Innovation (JIII)) are applied advantageously. As a developing machine used therein, the film processor disclosed in the *Koukai Giho* (Journal of Technical Disclosure) cited above, page 3, right column, lines 22–28, is preferred.

Examples of an automatic developing machine and an evaporation correction method suitable for practical use of the present granular processing agents can be found in the *Koukai Giho* (Journal of Technical Disclosure) cited above, page 5, right column, line 11, to page 7, right column, last line.

Further, photosensitive materials applicable to the present photographic processing system are described. As described above in relation to the aims and the background of the invention, the photosensitive materials applicable to the present photographic processing system include picture-taking color photographic materials, color photographic paper, picture-taking black-and-white photographic materials and black-and-white photographic paper, which prevail in the photo market. These photosensitive materials each have at least one light-sensitive layer on a support. A typical example of such materials is a silver halide photographic material having on a support at least one light-sensitive layer made up of a plurality of silver halide emulsion layers differing from one another in sensitivity but having substantially the same color sensitivity.

In picture-taking multilayer silver halide color photographic materials, each of the light-sensitive layers is a unit light-sensitive layer having sensitivity to any of blue light, green light and red light. As to the arranging order of these unit light-sensitive layers from the support side, it is general to provide a red-sensitive layer, a green sensitive layer and a blue-sensitive layer in the order presented. Depending on the desired purpose, however, the unit light-sensitive layers may be arranged in inverse order, or it is permitted to take an arranging order such that a layer having certain color sensitivity is sandwiched between layers constituting a unit light-sensitive layer having color sensitivity different from that of the layer sandwiched. Further, light-insensitive layers may be provided between the silver halide light-sensitive layers, and in the topmost and the lowest positions. In these layers, couplers as described below, DIR compounds and color mix inhibitors may be contained. As to the two or more silver halide emulsion layers constituting each unit light-sensitive layer, it is appropriate that a high-speed emulsion layer and a low-speed emulsion layer be arranged in decreasing order of sensitivity toward the support as disclosed in DE 1,121,470 and GB 923,045. On the other hand, as disclosed in JP-A-57-112751, JP-A-62-200350, JP-A-62-206541 and JP-A-62-206543, it is allowable to arrange a low-speed emulsion layer on the side distant from the support and a high-speed emulsion layer on the side near the support.

For instance, from the side most distant from the support, a low-speed blue-sensitive layer (BL), a high-speed blue-sensitive layer (BH), a high-speed green-sensitive layer (GH), a low-speed green-sensitive layer (GL), a high-speed red-sensitive layer (RH) and a low-speed red-sensitive layer (RL) can be arranged in the order described. The arranging order may also be BH, BL, GL, GH, RH and RL, or it may be BH, BL, GH, GL, RL and RH, too. Further, as disclosed in JP-B-55-34932, the arrangement in the order of blue-sensitive layer/GH/RH/GL/RL from the side most distant from the support can be adopted. Furthermore, as disclosed in JP-A-56-25738 and JP-A-62-63936, the arrangement in the order of blue-sensitive layer/GL/RL/GH/RH from the side most distant from the support can be adopted, too.

In addition, as disclosed in JP-B-49-15495, it is permitted that three layers differing in sensitivity are arranged in the decreasing order of sensitivity towards a support. Specifically, the silver halide emulsion layer having the highest sensitivity is arranged as the upper layer, the silver halide emulsion layer having the sensitivity lower than that of the upper layer is arranged as the intermediate layer and the silver halide emulsion layer having the sensitivity lower than that of the intermediate layer is arranged as the lower layer. In the case where three layers arranged are different in sensitivity to light but the same in color sensitivity, as disclosed in JP-A-59-202464, the arrangement in the order of the medium-speed emulsion layer, the high-speed emulsion layer and the low-speed emulsion layer from the side distant from the support may also be adopted. The arrangements in other orders, namely the order of high-speed emulsion layer/low-speed emulsion layer/medium-speed emulsion layer and the order of low-speed emulsion layer/medium-speed emulsion layer/high-speed emulsion layer, may be adopted. In the cases of arranging 4 or more layers differing in sensitivity to light, the order of arrangement may be various as described above.

For improvement of color reproducibility, as disclosed in U.S. Pat. Nos. 4,663,271, 4,705,744 and 4,707,436, JP-A-62-160448 and JP-A-63-89850, it is favorable that donor layers (CL) having interlayer effects and differing in spectral sensitivity distribution from main light-sensitive layers, such as BL, GL and RL, are arranged in the positions adjacent to or in vicinity of the main light-sensitive layers.

Silver halide suitably used in picture-taking materials is silver iodobromide, iodochloride or iodochlorobromide having an iodide content of about 30 mole % or below. In particular, silver iodobromide or iodochlorobromide having an iodide content of from about 2 mole % to about 10 mole % is preferred.

The silver halide grains in photographic emulsions may be grains having a regular crystal shape, such as that of a cube, an octahedron or a tetradecahedron, or an irregular crystal shape, such as that of a sphere or a tablet, or grains having crystal defects, such as a twin plane, or grains having a composite crystal shape. The grain size of silver halide may be in a wide range, because grains are formed so as to be suited for each individual light-sensitive layer. Specifically, any grains including fine grains having a projected area diameter of 0.1 to 0.2 μm and coarse grains having a projected area diameter of 1.0 to 10 μm may be used. Further, the emulsions used may be polydisperse or monodisperse emulsions.

In the color photosensitive materials, it is advantageous to use light-insensitive fine-grain silver halide. The light-insensitive fine-grain silver halide is defined as the fine grains of silver halide which are neither sensitized by imagewise exposure for forming dye images nor developed in a substantial sense at the development-processing step. And it is preferable that these fine grains are not fogged in advance. The fine-grain silver halide has a bromide content of 0 to 100 mole %, and may contain chloride and/or iodide, if desired. Preferably, 0.5 to 10 mole % of iodide is contained therein. The suitable average diameter (mean value of diameters of circles having the areas equivalent to projected areas of grains) of fine grains is from 0.01 to 0.5 μm, preferably from 0.02 to 0.2 μm. The fine-grain silver halide can be prepared in the same manner as general light-sensitive silver halide. It is not necessary for the silver halide grain surface to undergo optical sensitization and spectral sensitization. However, prior to adding them to a coating solution, it is appropriate that known stabilizers, such as triazole compounds, azaindene compounds, benzothiazolium compounds, mercapto compounds or zinc compounds, be added to the coating solution. In the layer containing such fine-grain silver halide, colloidal silver can be incorporated.

The suitable silver coverage of a color photosensitive material used in the invention is 0.6 g/m$^2$ or below, preferably 4.5 g/m$^2$ or below.

In the color photosensitive material used in the invention, the suitable total layer thickness of all hydrophilic colloidal layers present on the emulsion layer side is 28 μm or below, preferably 23 μm or below, far preferably 18 μm or below, particularly preferably 16 μm or below. And the layer swelling speed $T_{1/2}$ is preferably 30 seconds or below, particularly preferably 20 seconds or below. The term $T_{1/2}$ is defined as the time required for the layer thickness to reach one-half the saturated layer thickness determined as 90% of the maximum swollen layer thickness to which the layer reaches when processed with a color developer at a temperature of 30° C. for a period of 3 minutes and 15 seconds. The term "layer thickness" as used herein means the layer thickness measured under a temperature of 25° C. and a relative humidity regulated at 55% (2 days). And the value of $T_{1/2}$ can be determined by use of a swellometer of the type described in A. Green et al., *Photogr. Sci. Eng.*, Vol. 19, No. 2, pp. 124–129. The value of $T_{1/2}$ can be adjusted by adding a hardener to gelatin used as a binder, or by changing the aging condition after coating. The suitable rate of swelling is from 150 to 400%. The "rate of swelling" can be calculated from the maximum swollen layer thickness under the aforementioned conditions by use of the equation:

(maximum swollen layer thickness−layer thickness)/layer thickness.

On the other hand, the crystal shape of silver halide grains contained in photographic emulsions preferably used for making prints may be any of regular crystal shapes, such as those of a cube, a tetradecahedron and an octahedron, shapes having irregular crystal habits, such as a sphere and a tablet, and composites of these shapes. As to the tabular grains, one pair of parallel surfaces perpendicular to the thickness direction is referred to as the major surfaces. In the invention, it is preferable to use photographic emulsions containing tabular grains having {111} or {100} faces as major surfaces. With respect to the formation of {111} tabular grains, the methods using various crystal-phase controllers are disclosed. For instance, the compounds disclosed in JP-A-2-32 (Compound Examples 1 to 42) are used to advantage.

The grains having a silver chloride content of at least 80 mole % are referred to as high-chloride silver halide grains. To such grains, it is appropriate that the chloride content be 95 mole % or more. And it is preferable that the grains used in the invention have the so-called core/shell structure constituted of a core part and a shell part surrounding the core part. The suitable chloride content in the core part is at least 90 mole %. The core part may be made up of two or more sections differing in halide composition. The suitable proportion of the shell part in each grain is not higher than 50%, especially not higher than 20%, of the total grain volume. The shell part is preferably silver iodochloride or silver iodobromochloride. The suitable iodide content in the shell part is from 0.5 mole % to 13 mole %, especially from 1 mole % to 13 mole %. And the suitable iodide content in the entire grain is not higher than 5 mole %, especially not higher than 1 mole %. It is appropriate that the bromide content be higher in the shell part than in the core part. The suitable bromide content is not higher than 20 mole %, particularly not higher than 5 mole %.

Silver halide grains incorporated in photosensitive materials for photographic paper use have no particular restrictions as to their average grain size (sphere-equivalent diameter on a volume basis). However, the average grain sizes ranging from 0.1 μm to 0.8 μm, especially from 0.1 to 0.6 μm, are preferred. As to the tabular grains, it is appropriate that the circle-equivalent diameters thereof be in the range of 0.2 to 1.0 μm. The term diameter of each individual silver halide grain refers to the diameter of a circle having the same area as the projected area of each individual grain on an electron micrograph. The grain thickness is not greater than 0.2 μm, preferably 0.15 μm or below, particularly preferably 0.12 μm or below. The grain size distribution of silver halide grains may be polydisperse or monodisperse, but it is advantageous that the silver halide grains have a monodisperse size distribution. In particular, it is preferred that the tabular grains constituting at least 50% of the total grains on a projected area basis have a variation coefficient of 20% or below, ideally 0%, with respect to the circle-equivalent diameters thereof.

Then, color photosensitive materials for picture-taking and print-making uses are both described below.

Silver halide photographic emulsions usable in the invention can be prepared using the methods as described, e.g., in *Research Disclosure* (hereinafter abbreviated as "RD"), No.

17643(December 1978), pp. 22–23, entitled "I. Emulsion Preparation and Types"; ibid., No. 18716 (November 1979), p. 648; ibid., No. 307105 (November 1989), pp. 863–865; P. Glafkides, *Chemie et Physique Photographigue*, Paul Montel (1967); G. F. Duffin, *Photographic Emulsion Chemistry*, The Focal Press (1966); and V. L. Zelikman, et al., *Making and Coating Photographic Emulsion*, The Focal Press (1964). The monodisperse emulsions disclosed in U.S. Pat. Nos. 3,574,628 and 3,655,394, and GB No. 1,413,748 are also used to advantage.

The tabular grains having an aspect ratio of about 3 or above can also be used in the photosensitive materials to which the present processing system is applicable. Such tabular grains can be prepared with ease in accordance with the methods as described in Gutoff, *Photographic Science and Engineering*, vol. 14, pp. 248–257 (1970); U.S. Pat. Nos. 4,434,226, 4,414,310, 4,439,048 and 4,439,520; and GB No. 2,112,157. Such grains may be uniform throughout in crystal structure, they may be different in halide composition between the inner part and the outer part, or they may form a layer structure. Further, silver halide phases differing in halide composition may be joined together by epitaxial junction, or compounds other than silver halide, such as silver rhodanide and zinc oxide, may be bonded to a silver halide phase. In addition, mixtures of grains having different crystal forms may be used.

The emulsions may have any types of latent images. In other words, the emulsions used may be surface-latent-image type emulsions which form latent images predominantly at the surface of grains, or internal latent-image type emulsions which mainly form latent images inside the grains, or emulsions of the type which form latent images in both surface and internal parts. However, they are required to be negative emulsions. Of the internal latent-image type emulsions, the core/shell emulsion of internal latent-image type as disclosed in JP-A-63-264740 may be used, and such an emulsion can be prepared by the method disclosed in JP-A-59-133542. The suitable shell thickness of this emulsion, though varies depending on the conditions of development-processing, is in the range of 3 to 40 nm, preferably 5 to 20 nm.

In general, silver halide emulsions used in the invention are those having undergone physical ripening, chemical ripening and spectral sensitization. The additives used in these sensitizing steps are described in RD No. 17643, RD No. 18716 and RD No. 307105, and the locations where they are described in each of those references are listed below. Color photographic materials used in the invention can contain in at least one of their respective constituent layers a mixture of two or more light-sensitive silver halide emulsions differing in at least one characteristic, such as grain size, grain size distribution, halide composition, grain shape or sensitivity. It is advantageous to use the surface-fogged silver halide grains disclosed in U.S. Pat. No. 4,082,553, the inside-fogged silver halide grains disclosed in U.S. Pat. No. 4,626,498 and JP-A-59-214852, or colloidal silver in light-sensitive silver halide emulsion layers and/or substantially light-insensitive hydrophilic colloidal layers. The term "inside- or surface-fogged silver halide grains" as used herein refers to the silver halide grains capable of being developed uniformly (non-imagewise) irrespective of whether they are present in the unexposed area or the exposed area of photosensitive material. The preparation methods of such grains are described in U.S. Pat. No. 4,626,498 and JP-A-59-214852. The silver halide forming the core of an inside-fogged core/shell silver halide grains may have a different halide composition. The silver halide used for forming inside- or surface-fogged grains may be any of silver chloride, silver chlorobromide, silver iodobromide and silver chloroiodobromide. The photographic additives usable in color photographic materials are also described in RDs, and the locations at which they are described are also shown below.

| Kinds of Additives | RD 17643 | RD 18716 | RD 307105 |
|---|---|---|---|
| 1. Chemical sensitizer | p. 23 | p. 648, right column | p. 866 |
| 2. Sensitivity increasing agent | | p. 648, right column | |
| 3. Spectral sensitizer and Super-sensitizer | pp. 23–24 | p. 648, right column, to p. 649, right column | pp. 866–868 |
| 4. Brightening agent | p. 24 | p. 647, right column | p. 868 |
| 5. Light absorbent, Filter dye, UV absorbent | pp. 25–26 | p. 649, right column, to p. 650, left column | p. 873 |
| 6. Binder | p. 26 | p. 651, left column | pp. 873–874 |
| 7. Plasticizer, Lubricant | p. 27 | p. 650, right column | p. 876 |
| 8. Coating aid, Surfactant | pp. 26–27 | p. 650, right column | pp. 875–876 |
| 9. Antistatic agent | p. 27 | p. 650, right column | pp. 876–877 |
| 10. Matting agent | — | | pp. 878–879 |

Various kinds of dye-forming couplers can be used in color photosensitive materials. The couplers recited below are preferred in particular.

Examples of such yellow couplers include the couplers represented by formulae (I) and (II) in EP-A-502424, the couplers represented by formulae (1) and (2) in EP-A-51496 (especially Y-28 illustrated on page 18), the couplers represented by formula (I) in claim 1 of EP-A-568037, the couplers represented by formula (I) on column 1, lines 45–55, of U.S. Pat. No. 5,066,576, the couplers represented by formula (I) in paragraph [0008] of JP-A-4-274425, the couplers described in claim 1 on page 40 of EP-A1-498381 (especially D-35 illustrated on page 18), the couplers represented by formula (Y) on page 4 of EP-A1-447969 (especially Y-1 on page 17 and Y-54 on page 41), and the couplers represented by formulae (II) to (IV) on column 7, lines 36–58, of U.S. Pat. No. 4,476,219 (especially II-17, II-19 (on column 17) and II-24 (on column 19)).

Examples of magenta couplers used preferably include the couplers disclosed in JP-A-3-39737 (L-57 (p. 11, lower right), L-68 (p. 12, lower right) and L-77 (p. 13, lower right)); the couplers disclosed in European Patent No. 456, 257, A-4-63 (p. 134), A-4-73 and A-4-75 (p. 139); the couplers disclosed in European Patent No. 486,965, M-4, M-6 (p. 26), and M-7 (p. 27); the couplers disclosed in EP-A-571959, M-45 (p. 19); the coupler disclosed in JP-A-5-204106, M-1 (p. 6); and the coupler disclosed in JP-A-4-362631, M-22 (paragraph [0237]).

Examples of cyan couplers used preferably include the couplers disclosed in JP-A-4-204843, CX-1, 3, 4, 5, 11, 12, 14 and 15 (pp. 14–16); the couplers disclosed in JP-A-4-43345, C-7, C-10 (p. 35), C-34, C-35 (p. 37), (I-1) and (I-17) (pp. 42–43); and the couplers represented by formulae (Ia) and (Ib) in claim 1 of JP-A-6-67385.

Examples of polymeric couplers used preferably include the couplers P-1 and P-5 (p. 11) disclosed in JP-A-2-44345.

As couplers capable of forming colored dyes having moderate diffusibility, those disclosed in U.S. Pat. No.

4,366,237, GB No. 2,125,570, EP-B-96873 and DE No. 3,234,533 are suitable. Couplers appropriate for compensating undesired absorption of developed colors include the yellow colored cyan couplers represented by formulae (CI), (CII), (CIII) and (CIV) illustrated on page 5 of EP-A1-456257 (especially YC-86 on page 84), the yellow colored magenta couplers ExM-7 (p. 202), EX-1 (p. 249) and EX-7 (p. 251) disclosed in the patent document cited above, the magenta colored cyan couplers CC-9 (column 8) and CC-13 (column 10) of U.S. Pat. No. 4,833,069, and the colorless masking couplers disclosed in U.S. Pat. No. 4,837,136 ((2) on column 8) and as formula (A) in claim 1 of WO92/11575 (especially the compounds illustrated on pages 36–45).

Examples of photographically useful group-releasing compounds which can be incorporated include the development inhibitor-releasing compounds represented by formulae (I), (II), (III) and (IV) on page 11 of EP-A1-378236, the bleach accelerator-releasing compounds represented by formulae (1) and (1') on page 5 of EP-A2-310125, the ligand-releasing compounds represented by LIG-X in claim 1 of U.S. Pat. No. 4,555,478, the leuco dye-releasing compounds exemplified as Compounds 1–6 on columns 3–8 of U.S. Pat. No. 4,749,641, the fluorescent dye-releasing compounds disclosed in claim 1 of U.S. Pat. No. 4,774,181, the development accelerator- or fogging agent-releasing compounds represented by any of formulae (1), (2) and (3) on column 3 of U.S. Pat. No. 4,656,123, and the compounds represented by formula (I) in claim 1 of U.S. Pat. No. 4,857,447, which release groups capable of being converted to dyes only by undergoing elimination.

Examples of additives, other than couplers, which can be added include known dispersing media for oil-soluble organic compounds, latices for impregnation with oil-soluble organic compounds, scavengers for oxidized color developing agents, stain inhibitors, discoloration inhibitors, hardeners, precursors of development inhibitors, stabilizers, antifoggants, chemical sensitizers, dyes, dispersions of microcrystalline dyes, and UV absorbers.

The invention can be applied to processing of various kinds of color photosensitive materials including color negative films for amateur use or motion picture use, color reversal films for slide or television use, color photographic paper and color positive films. In addition, the application to the lens-equipped film units disclosed in JP-B-2-32615 and JP-UM-B-3-39784 is also favorable.

Suitable examples of supports used in color photosensitive materials to which the present processing system is applicable include the materials as disclosed in the above-cited RD, No. 17643, p. 28, ibid., No. 18716, p. 647, right column, to p. 648., left column, and ibid., No. 307105, p. 879.

It is preferable that the color photosensitive materials to which the present processing system is applicable are each provided with hydrophilic colloid layers (referred to as backing layers) having a total dry thickness of 2 to 20 $\mu$m on the side opposite to the emulsion layer side. And it is appropriate that these backing layers contain the additives as recited above, such as light absorbents, filter dyes, ultraviolet absorbents, antistatic agents, hardeners, binders, plasticizers, lubricants, coating aids and surfactants. The suitable rate of swelling caused in the total backing layers is from 150 to 500%.

Many of color photosensitive materials to which the present processing system is applicable have magnetic recording layers. The term "magnetic recording layer" as used herein is defined as the layer formed by coating on a support a coating composition made up of magnetic particles dispersed in a binder and an aqueous or organic solvent.

In color photographic paper for color prints, a reflective support is employed. As the reflective support, a support material laminated with a plurality of waterproof resin layers, such as polyethylene or polyester layers, and containing a white pigment, such as titanium dioxide, in at least one of the waterproof resin layers is preferred in particular.

Further addition of a brightening agent to at least one of the waterproof resin layers is preferable. Alternatively, a brightening agent may be dispersed in a hydrophilic colloid layer of the photographic paper. Examples of a brightening agent suitably used in such layers include benzoxazole-type, coumarin-type and pyrazoline-type brightening agents, preferably benzoxazolylnaphthalene-type and benzoxazolylstilbene-type brightening agents. Such a brightening agent has no particular restriction as to the amount used, but preferably it is added in an amount of 1 to 100 mg/m$^2$. When the brightening agent is mixed with a waterproof resin, its proportion to the waterproof resin is from 0.0005 to 3 weight %, preferably from 0.001 to 0.5 weight %. As the reflective support, it is also allowable to use a material prepared by coating a white pigment-containing hydrophilic colloid layer on a transparent support or a reflective support as recited above. In addition, the reflective support may be a support having a mirror-reflective or secondary diffuse-reflective metallic surface.

In picture-taking color photosensitive materials, cellulose triacetate and polyester supports are used. For details of these support materials the descriptions in *Koukai Giho* (Journal of Technical Disclosure), Kougi No. 94-6023, issued by Hatsumei Kyoukai in 15th Mar. 1994, can be referred to. Polyesters are prepared using diol compounds and aromatic carboxylic acids as essential components. Examples of aromatic carboxylic acids usable therein include 2,6-, 1,5-, 1,4- and 2,7-napthalenedicarboxylic acids, terephthalic acid, isophthalic acid and phthalic acid, and examples of diol compounds usable therein include diethylene glycol, triethylene glycol, cyclohexane dimethanol, bisphenol A and bisphenol. Examples of polymers prepared by polymerization of those compounds include homopolymers, such as polyethylene terephthalate, polyethylene naphthalate, and polycyclohexanedimethanol terephthalate. Of these polymers, polyesters containing 50 to 100 mole % of 2,5-napthalenedicarboxylic acid as the carboxylic acid component are preferred over the others. In particular, polyethylene 2,6-naphthalate is used to advantage. The average molecular weight of polyesters usable herein is from about 5,000 to about 200,000. The Tg of polyesters used in the invention is 50° C. or above, preferably 90° C. or above. These polyesters may be kneaded with ultraviolet absorbents. In another way, the prevention of light piping can be effected by kneading polyesters with dyes or pigments made available for polyester use, such as Diaresin (trade name, produced by Mitsubish Chemical Co.) and Kayaset (trade name, produced by Nippon Kayaku Co., Ltd.).

The supports used in photosensitive materials to which the present processing system is applicable are preferably subjected to surface treatment directly or after coated with subbing layers for the purpose of bonding them to constituent layers of the photosensitive materials. Examples of such surface treatment include surface activation treatments, such as chemical treatment, mechanical treatment, corona discharge treatment, flame treatment, UV treatment, high-frequency treatment, glow discharge treatment, activated plasma treatment, laser treatment, mixed acid treatment and ozonolysis treatment. Of these surface treatments, UV irradiation treatment, flame treatment, corona treatment and glow treatment are preferred over the others.

In photosensitive materials to which the present processing system is applicable, it is preferable to use antistatic agents. Examples of such antistatic agents include carboxylic acids and the salts thereof, polymers containing sulfonates, cationic polymers and ionic surface-active compounds. However, the antistatic agent most advantageously used is crystalline fine particles of at least one metal oxide having volume resistivity of $10^7$ Ω·cm or below, preferably $10^5$ Ω·cm or below, and their particle sizes in the range of 0.001 to 1.0 μm, which is selected from the group consisting of zinc oxide, silicon dioxide, titanium dioxide, alumina, indium oxide, magnesium oxide, barium oxide, manganese oxide and vanadium oxide, or fine particles of compound oxides formed from those metal oxides (wherein Sb, P, B, In, S, Si or/and C are included), or fine particles of sol-state metal oxides or compound oxides formed from such metal oxides. The suitable content of such fine particles in a photosensitive material is from 5 to 500 mg/m$^2$, preferably from 10 to 350 mg/m$^2$. The suitable ratio of the addition amount of conductive crystalline oxides or their compound oxides to the amount of binders used is from 1/300 to 100/1, preferably 1/100 to 100/5.

It is preferable to impart slippability to color photosensitive materials used in the invention. Further, it is appropriate to provide slip agent-containing layers on both photosensitive-layer and backing-layer sides. The suitable slippability is from 0.25 to 0.01 as expressed in terms of coefficient of kinetic friction. The measurement for determining such slippability is made under a condition that a test sample is moved against a stainless ball having a diameter of 5 mm at a rate of 60 cm/min (at 25°, 60% RH). In this evaluation, the value on the same level is obtained even when the material against which the test sample is moved is replaced by the photosensitive layer surface. Examples of a slip agent usable therein include polyorganosiloxanes, higher fatty acid amides, metal salts of higher fatty acids, and esters of higher fatty acids and higher alcohol compounds. As the polyorganosiloxanes, polydimethylsiloxane, polydiethylsiloxane, polystyrylmethylsiloxane and polymethylphenylsiloxane can be used. The layers suitable for addition of such slip agents are the outermost layer of emulsion layers and a backing layer. Especially preferred slip agents are polydimethylsilocane and esters having long-chain alkyl groups.

It is also preferable that matting agents are present in the color photosensitive materials. The matting agents may be present on either side, the emulsion layer side or the baking side. In particular, it is advantageous to add them to the outermost layer on the emulsion layer side. The matting agents may be soluble in processing solutions or insoluble therein. The combined use of matting agents of these two types is effective. For example, polymethyl methacrylate particles, methyl methacrylate/methacrylic acid (9/1 to 5/5 by mole) copolymer particles and polystyrene particles are preferred as matting agents. The suitable particle sizes of those polymers are in the range of 0.8 to 10 μm. As to the particle size distribution, the narrower, the better. More specifically, it is appropriate that at least 90% of the total number of particles be particles having their respective sizes in the range of 0.9 to 1.1 times the average size. For enhancing the matting capability, it is effective to add fine particles smaller than 0.8 μm in size and the aforementioned particles simultaneously. Examples of such fine particles include polymethyl methacrylate particles (0.2 μm), methyl methacrylate/methacrylic acid (9/1 by mole) copolymer particles (0.3 μm), polystyrene particles (0.25 μm) and colloidal silica (0.03 μm).

The above paragraphs have described the color photosensitive materials to which the present processing system is applicable. Those descriptions of color photosensitive materials for picture-taking and printing uses, except the description of color development, hold true in a substantial sense for positive black-and-white photosensitive materials for picture-taking and printing uses, to which the present processing system is applicable.

As printers for making prints by the processing based on the present photographic processing system, general-purpose printers can be used. In addition, the present processing system is not only applicable in print systems using general negative printers, but also suitable for the scanning exposure systems using cathode-ray tubes (CRT). CRT exposure devices are simple, compact and inexpensive, compared with laser-utilized devices. Further, it is easy for them to adjust their optical axes and colors. In cathode-ray tubes for imagewise exposure, various kinds of luminophors enabling light emission in spectral regions as required are used. More specifically, one of red luminophors, green luminophors and blue luminophors, or a mixture of two or more of them can be used therein. The spectral regions are not limited to the red, green and blue ones as mentioned above, but phosphors emitting yellow light, orange light, violet light or light in the infrared region may also be used. In many cases, cathode-ray tubes enabling emission of white light by using those luminophors in mixed states are employed.

In the case of using a photosensitive material having two or more light-sensitive layers differing in spectral sensitivity distribution and a cathode-ray tube having phosphors capable of emitting light in two or more different spectral regions, simultaneous exposure to lights of two or more different colors, or light emission from the tube surface by inputting image signals of two or more different colors into the cathode-ray tube, may be performed. Alternately, the method of inputting image signals of different colors sequentially into a cathode-ray tube to cause the tube to emit light of each color in succession and performing exposure to the thus emitted light through a film capable of cutting off colors other than the color of emitted light (sequential mask exposure) maybe adopted. In general, the sequential mask exposure is favorable for enhancement of image quality, because it permits the use of a high-resolution cathode-ray tube.

The photosensitive materials to which the present processing system is applicable are suitable for adoption of a digital scanning exposure system utilizing monochromatic high-intensity light from gas laser, light-emitting diode, semiconductor laser, or a second harmonic generation source (SHG) in which semiconductor laser or solid laser using semiconductor laser as an optically pumping source is combined with a nonlinear optical crystal. From the standpoint of rendering the system compact and inexpensive, it is advantageous to use semiconductor laser, or a second harmonic generation source (SHG) in which semiconductor laser or solid laser using semiconductor laser as an optically pumping source is combined with a nonlinear optical crystal. In order to design a compact, low-priced, long-life, highly stable device, the use of semiconductor laser is preferred in particular, and it is advisable to use semiconductor laser as at least one of exposure light sources.

When such scanning exposure light sources are used, the maximum spectral sensitization wavelengths of photosensitive materials to which the present processing system is to be applied can be chosen depending on what wavelengths the scanning exposure light sources have. In the case of an SHG light source obtained by combining solid laser using semiconductor laser as optically pumping source or semiconductor laser with a nonlinear optical crystal, the lasing wavelength can be reduced to half, so that blue light and green light can be obtained. Therefore, it is possible to let the photosensitive materials have the spectral sensitivity maxima in the general three wavelength regions, namely blue, green and red regions. Defining the exposure time in such scanning exposure as the time required for exposing the area of one pixel size in the case of a pixel density of 400 dpi, the suitable scanning exposure time is $10^{-4}$ second or below, preferably $10^{-6}$ second or below. In addition, for the purpose of preventing unauthorized copies of photosensitive materials having undergone the processing relating to the invention, latent images with microdot patterns can be imparted to the photosensitive materials. The method for imparting such latent images to photosensitive materials can be found in JP-A-9-226227.

The scanning exposure systems which can be suitably applied to the invention are disclosed in detail in the publications cited in the above table. For the processing of photosensitive materials to which the present processing system is applicable, the processing materials and processing methods disclosed in JP-A-2-207250, page 26, lower right column, line 1, to page 34, upper right column, line 9, and JP-A-4-97355, page 5, upper left column, line 17, to page 18, lower right column, line 20, can be used to advantage.

EXAMPLES

Now, the invention is illustrated in detail by reference to the following examples, but these examples should not be construed as limiting the scope of the invention in any way.

Example 1

Color paper described below was prepared, and photographic processing thereof was carried out using a processing agent regenerated in accordance with the invention. By this photographic processing, the present method and processing agent were evaluated.

(1) Preparation of Color Paper:

A silver halide color photographic material (Sample No. 101) having a layer structure described below was prepared by subjecting a paper support coated with polyethylene resin on both sides to corona discharge treatment, then providing on the support surface a gelatin undercoat layer containing sodium dodecylbenzenesulfonate, and further coating the undercoat layer sequentially with first to seventh photographic constituent layers.

As gelatin hardeners in each constituent layer, sodium 1-oxy-3,5-dichloro-s-triazine (H-1) and Hardener (H-2) were used. In addition, (Ab-1), (Ab-2), (Ab-3) and (Ab-4) were added to each layer so that their total coverage values were 15.0 mg/m$^2$, 60.0 mg/m$^2$, 5.0 mg/m$^2$ and 10.0 mg/m$^2$, respectively.

(Ab-1) Antiseptic

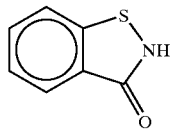

(Ab-2) Antiseptic

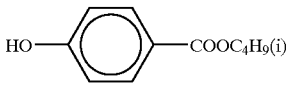

(Ab-3) Antiseptic

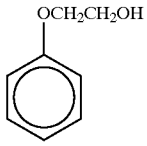

(Ab-4) Antiseptic
1:1:1:1 (by mole) Mixture of a, b, c and d

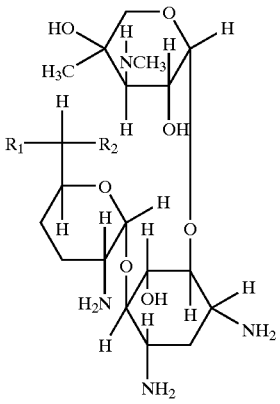

| | $R_1$ | $R_2$ |
|---|---|---|
| a | $CH_3$ | $NHCH_3$ |
| b | $CH_3$ | $NH_2$ |
| c | H | $NH_2$ |
| d | H | $NHCH_3$ |

(HA-1)

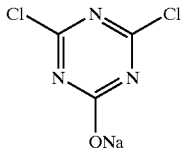

(HA-2)

The spectral sensitizing dyes illustrated below were incorporated in silver chlorobromide emulsions used for each light-sensitive emulsion layer.

Blue-sensitive Emulsion Layer (Sensitizing Dye A)

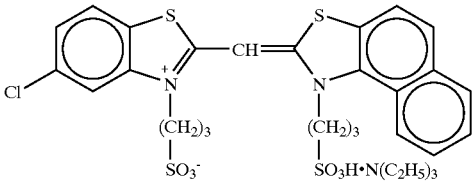

(Sensitizing Dye B)

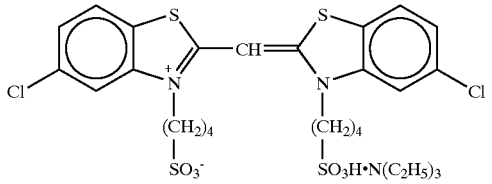

(Sensitizing Dye C)

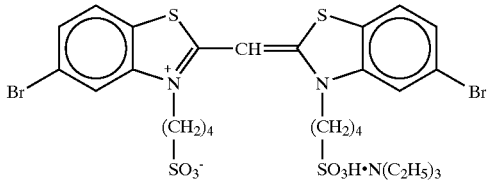

(Sensitizing Dyes A, B and C illustrated above were each added to the large-sized emulsion in an amount of $1.4\times10^{-4}$ mole per mole silver halide and to the small-size emulsion in an amount of $1.7\times10^{-4}$ mole per mole silver halide.)

Green-sensitive Emulsion Layer (Sensitizing Dye D)

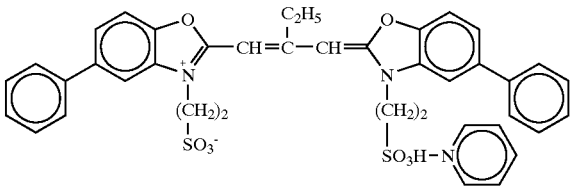

(Sensitizing Dye E)

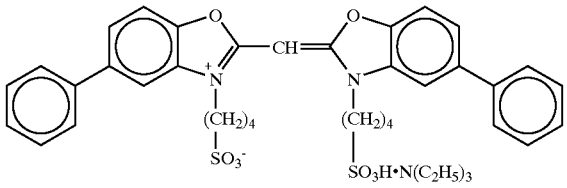

(Sensitizing Dye F)

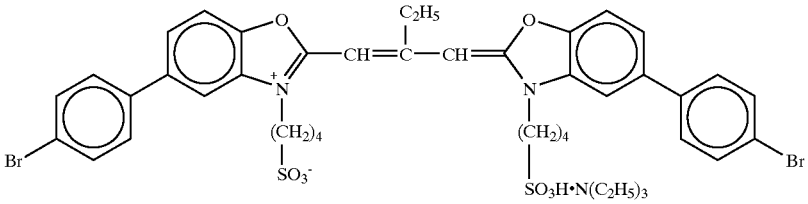

(The amounts of Sensitizing Dye D added to the large-sized emulsion and the small-sized emulsion were $3.0\times10^{-3}$ mole per mole silver halide and $3.6\times10^{-4}$ mole per mole silver halide, respectively, and those of Sensitizing Dye E added to the large-sized emulsion and the small-sized emulsion were $4.0\times10^{-6}$ mole per mole silver halide and $7.0\times10^{-5}$ mole per mole silver halide, respectively, and those of Sensitizing Dye F added to the large-sized emulsion and the small-sized emulsion were $2.0\times10^{-2}$ mole per mole silver halide and $2.8\times10^{-4}$ mole per mole silver halide, respectively.)

Red-sensitive Emulsion Layer (Sensitizing Dye G)

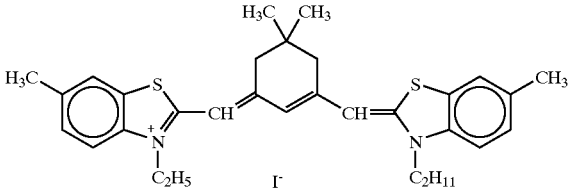

(Sensitizing Dye H)

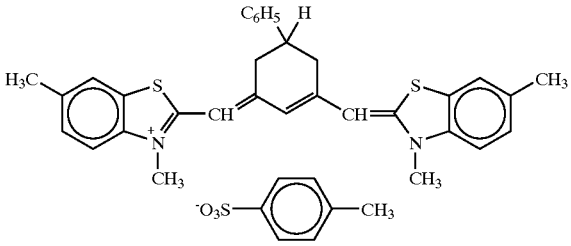

(Sensitizing Dyes G and H were each added to the large-sized emulsion in an amount of $6.0\times10^{-5}$ mole per mole silver halide and to the small-size emulsion in an amount of $9.0\times10^{-5}$ mole per mole silver halide. In addition, the following Compound I was added to the red-sensitive emulsion layer in an amount of $2.5\times10^{-3}$ mole per mole silver halide.)

(Compound I)

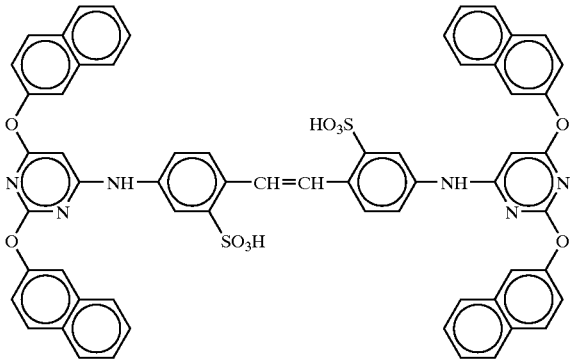

Further, 1-(3-methylureidophenyl)-5-mercaptotetrazole was added to the blue-sensitive emulsion layer, the green-sensitive emulsion layer and the red-sensitive emulsion layer in amounts of $3.3\times10^{-4}$ mole, $1.0\times10^{-3}$ mole and $5.9\times10^{-4}$ mole, respectively, per mole silver halide. Furthermore, 1-(3-methylureidophenyl)-5-mercaptotetrazole was added to the second layer, the fourth layer, the sixth layer and the seventh layer so as to have coverage values of 0.2 mg/m$^2$, 0.2 mg /m$^2$, 0.6 mg/m$^2$ and 0.1 mg/m$^2$, respectively. In addition, 4-hydroxy-6-methyl-1,3,3a,7-tetraazaindene was added to the blue-sensitive emulsion layer and the green-sensitive emulsion layer in amounts of $1\times10^{-4}$ mole and $2\times10^{-4}$ mole, respectively, per mole silver halide, and methacrylic acid-butylacrylate (1:1 by weight) copolymer (average molecular weight: 200,000 to 400,000) was added to the red-sensitive emulsion layer so as to have coverage of 0.05 g/m$^2$. Moreover, disodium catechol-3,5-disulfonate was added to the second layer, the fourth layer and the sixth layer so as to have coverage values of 6 mg/m$^2$, 6 mg/m$^2$ and 18 mg/m$^2$, respectively.

For preventing irradiation, the following dyes were added to the emulsion layers (each figure in parentheses designates the coverage).

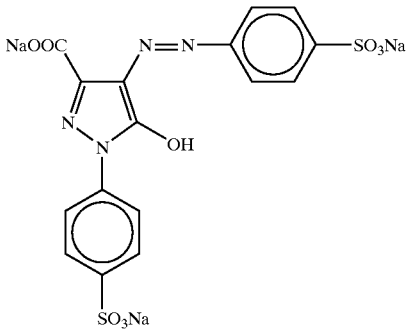

(2 mg/m$^2$)

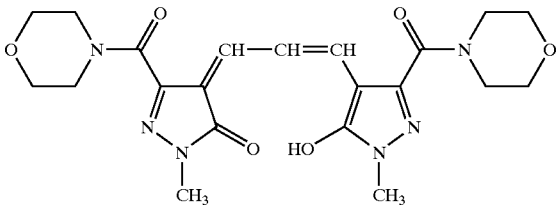

(5 mg/m$^2$)

-continued

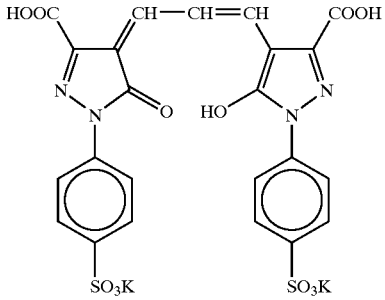

(1 mg/m$^2$)

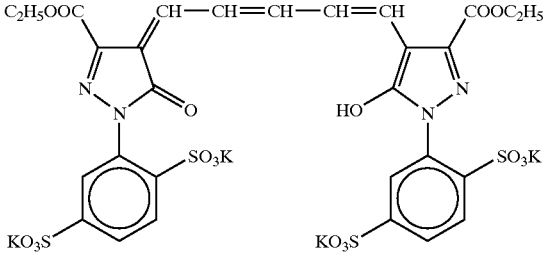

(10 mg/m$^2$)

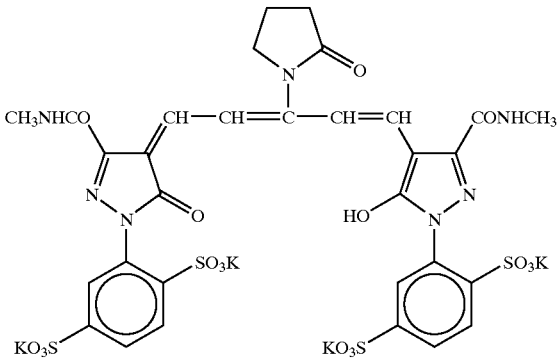

(10 mg/m$^2$)

(Layer Structure)

The composition of each constituent layer is described below. Each figure on the right side designates the coverage (g/m$^2$) of the ingredient corresponding thereto. As to the silver halide emulsion, the figure represents the coverage based on silver.

Support:

Polyethylene resin-laminated paper containing white pigments ($TiO_2$ content: 16 weight %, ZnO content: 4 weight %), a brightening agent (4,4'-bis(benzoxazolyl)stilbene/4,4'-bis(5-methylbenzoxazolyl)stilbene (8/2) mixture content: 0.05 weight %) and a bluish dye (ultramarin) in the polyethylene resin on the side of the first layer.

First Layer (Blue-sensitive Emulsion Layer):

| | |
|---|---|
| Silver chlorobromide Emulsion A (having a cubic crystal form and being a 3:7 (by mole on a silver basis) mixture of large-sized Emulsion A having an average grain size of 0.72 μm and a variation coefficient of 0.08 with respect to grain size distribution and a small-sized Emulsion A having an average grain size of 0.60 μm and a variation coefficient | 0.25 |

-continued

| | |
|---|---|
| of 0.10 with respect to grain size distribution, which each contained 0.3 mole % of AgBr localized in part of the grain surface made up mainly of silver chloride) | |
| Gelatin | 1.35 |
| Yellow coupler (ExY-1) | 0.41 |
| Yellow coupler (ExY-2) | 0.21 |
| Color image stabilizer (Cpd-1) | 0.08 |
| Color image stabilizer (Cpd-2) | 0.04 |
| Color image stabilizer (Cpd-3) | 0.08 |
| Color image stabilizer (Cpd-8) | 0.04 |
| Solvent (Solv-1) | 0.23 |

Second Layer (Color Mixing Inhibiting Layer):

| | |
|---|---|
| Gelatin | 1.00 |
| Color mixing inhibitor (Cpd-4) | 0.05 |
| Color mixing inhibitor (Cpd-5) | 0.07 |
| Color image stabilizer (Cpd-6) | 0.007 |
| Color image stabilizer (Cpd-7) | 0.14 |
| Color image stabilizer (Cpd-13) | 0.006 |
| Color image stabilizer (Cpd-21) | 0.01 |
| Solvent (Solv-1) | 0.06 |
| Solvent (Solv-2) | 0.22 |

Third Layer (Green-sensitive Emulsion Layer):

| | |
|---|---|
| Silver chlorobromide Emulsion B (having a cubic crystal form and being a 1:3 (by mole on a silver basis) mixture of large-sized Emulsion B having an average grain size of 0.45 μm and a variation coefficient of 0.10 with respect to grain size distribution and a small-sized Emulsion B having an average grain size of 0.35 μm and a variation coefficient of 0.08 with respect to grain size distribution, which each contained 0.4 mole % of AgBr localized in part of the grain surface made up mainly of silver chloride) | 0.12 |
| Gelatin | 1.20 |
| Magenta coupler (ExM-1) | 0.13 |
| Ultraviolet absorbent (UV-1) | 0.05 |
| Ultraviolet absorbent (UV-2) | 0.02 |
| Ultraviolet absorbent (UV-3) | 0.02 |
| Ultraviolet absorbent (UV-4) | 0.03 |
| Color image stabilizer (Cpd-2) | 0.01 |
| Color image stabilizer (Cpd-4) | 0.002 |
| Color image stabilizer (Cpd-7) | 0.08 |
| Color image stabilizer (Cpd-8) | 0.01 |
| Color image stabilizer (Cpd-9) | 0.03 |
| Color image stabilizer (Cpd-10) | 0.01 |
| Color image stabilizer (Cpd-11) | 0.0001 |
| Color image stabilizer (Cpd-13) | 0.004 |
| Solvent (Solv-3) | 0.10 |
| Solvent (Solv-4) | 0.19 |
| Solvent (Solv-5) | 0.17 |

Fourth Layer (Color Mixing Inhibiting Layer):

| | |
|---|---|
| Gelatin | 0.71 |
| Color mixing inhibitor (Cpd-4) | 0.04 |
| Color mixing inhibitor (Cpd-5) | 0.05 |
| Color image stabilizer (Cpd-6) | 0.005 |
| Color image stabilizer (Cpd-7) | 0.10 |
| Color image stabilizer (Cpd-13) | 0.004 |

-continued

| | |
|---|---|
| Color image stabilizer (Cpd-21) | 0.01 |
| Solvent (Solv-1) | 0.04 |
| Solvent (Solv-2) | 0.16 |

Fifth Layer (Red-sensitive Emulsion Layer):

| | |
|---|---|
| Silver chlorobromide Emulsion C (having a cubic crystal form and being a 1:4 (by mole on a silver basis) mixture of large-sized Emulsion C having an average grain size of 0.50 μm and a variation coefficient of 0.09 with respect to grain size distribution and a small-sized Emulsion C having an average grain size of 0.41 μm and a variation coefficient of 0.11 with respect to grain size distribution, which each contained 0.8 mole % of AgBr localized in part of the grain surface made up mainly of silver chloride) | 0.16 |
| Gelatin | 1.00 |
| Cyan coupler (ExC-1) | 0.05 |
| Cyan coupler (ExC-2) | 0.18 |
| Cyan coupler (ExC-3) | 0.024 |
| Ultraviolet absorbent (UV-1) | 0.04 |
| Ultraviolet absorbent (UV-3) | 0.01 |
| Ultraviolet absorbent (UV-4) | 0.01 |
| Color image stabilizer (Cpd-1) | 0.23 |
| Color image stabilizer (Cpd-9) | 0.01 |
| Color image stabilizer (Cpd-12) | 0.01 |
| Color image stabilizer (Cpd-13) | 0.01 |
| Solvent (Solv-6) | 0.23 |

Sixth Layer (Ultraviolet Absorbing Layer):

| | |
|---|---|
| Gelatin | 0.46 |
| Ultraviolet absorbent (UV-1) | 0.14 |
| Ultraviolet absorbent (UV-2) | 0.05 |
| Ultraviolet absorbent (UV-3) | 0.05 |
| Ultraviolet absorbent (UV-4) | 0.04 |
| Ultraviolet absorbent (UV-5) | 0.03 |
| Ultraviolet absorbent (UV-6) | 0.04 |
| Solvent (Solv-7) | 0.18 |

Seventh Layer (Protective Layer):

| | |
|---|---|
| Gelatin | 1.00 |
| Acryl-modified polyvinyl alcohol (modification degree: 17%) | 0.04 |
| Liquid paraffin | 0.02 |
| Surfactant (Cpd-14) | 0.01 |
| Surfactant (Cpd-15) | 0.01 |

The structural formulae of the compounds used herein are illustrated below:
(ExY-1) Yellow Coupler
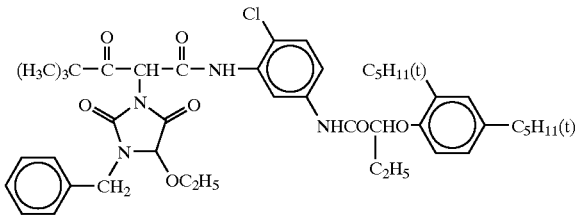
(ExY-2) Yellow Coupler
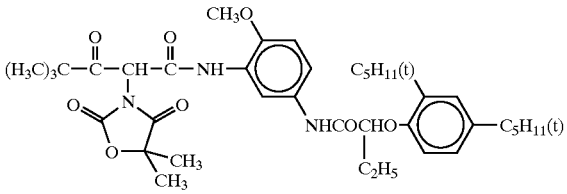
(ExM-1) Magenta Coupler
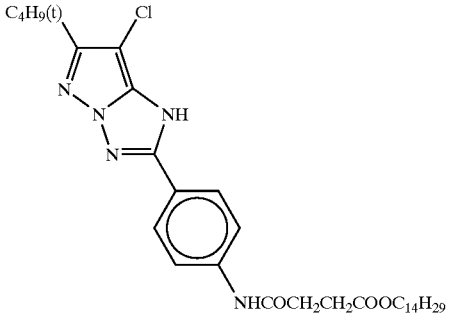
(ExC-1) Cyan Coupler
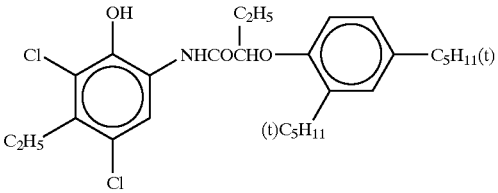
(ExC-2) Cyan Coupler
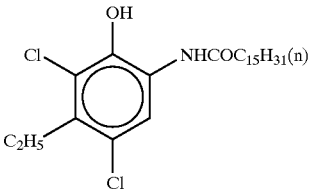
(ExC-3) Cyan Coupler
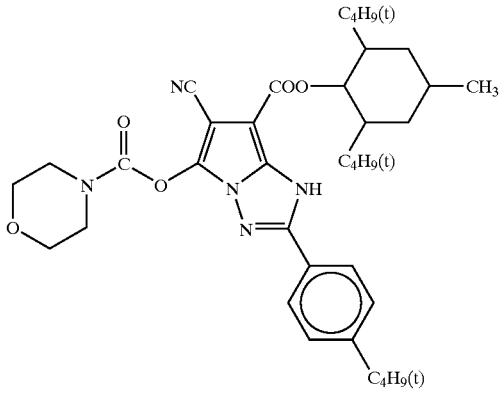
(Cpd-1) Color Image Stabilizer
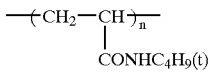
number average molecular weight: 60,000
(Cpd-2) Color Image Stabilizer
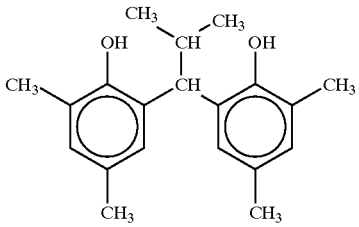
(Cpd-3) Color Image Stabilizer
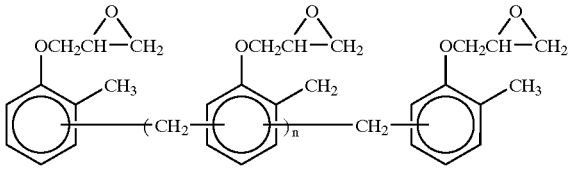
n=7–8 (on average)
(Cpd-4) Color Mixing Inhibitor
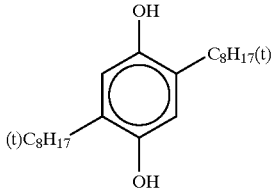

(Cpd-5) Color Mixing Inhibitor
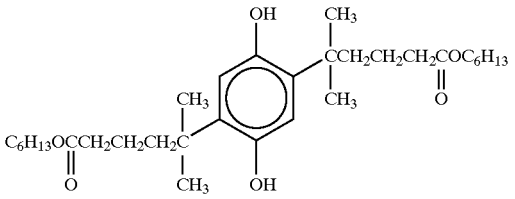
(Cpd-6) Color Mixing Inhibitor
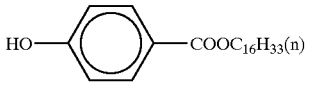
(Cpd-7) Stabilizer
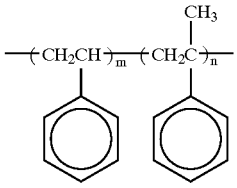
number average molecular weight: 600
m/n=10/90
(Cpd-8) Color Image Stabilizer
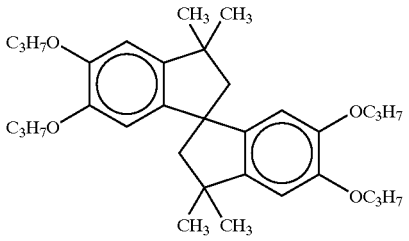
(Cpd-9) Color Image Stabilizer
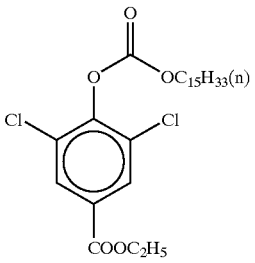
(Cpd-10) Color Image Stabilizer
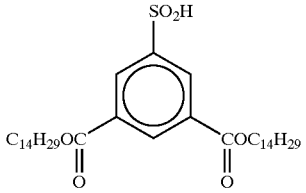
(Cpd-11)
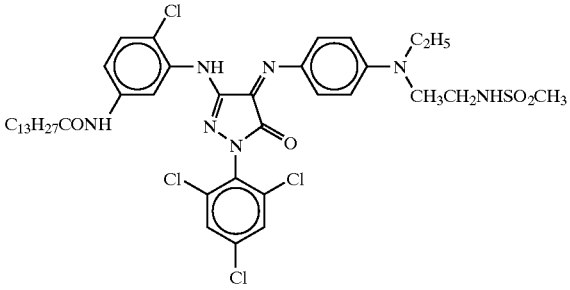
(Cpd-12) Color Image Stabilizer
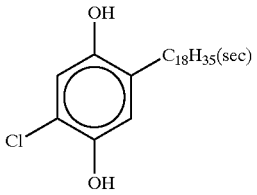
(Cpd-13) Color Image Stabilizer
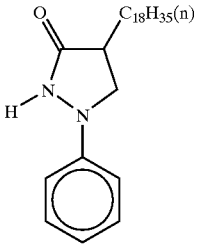
(Cpd-14) Surfactant
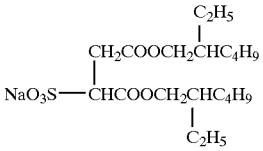
(Cpd-15) Surfactant
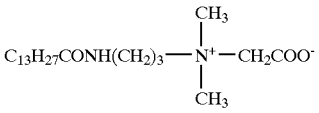

(Cpd-16)
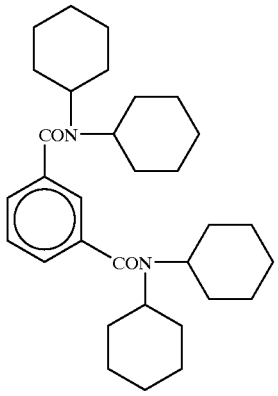
(Cpd-17)
1:1 Mixture of
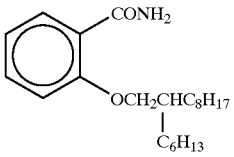
and
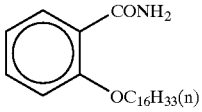
(Cpd-18)
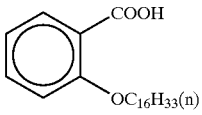
(Cpd-19)
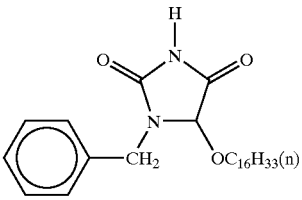
(Cpd-20)
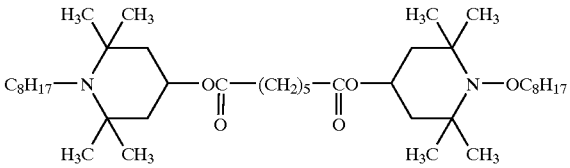
(Cpd-21) Color Image Stabilizer
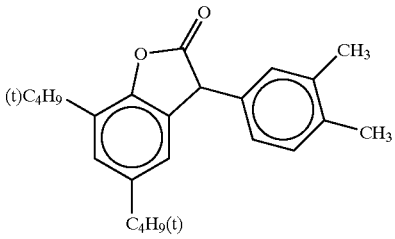
(UV-1) Ultraviolet Absorbent
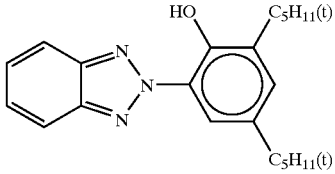
(UV-2) Ultraviolet Absorbent
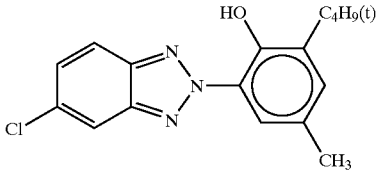
(UV-3) Ultraviolet Absorbent
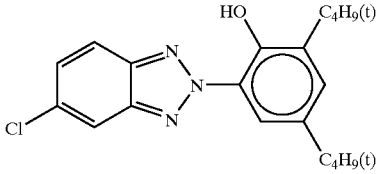
(UV-4) Ultraviolet Absorbent
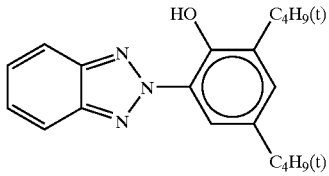
(UV-5) Ultraviolet Absorbent
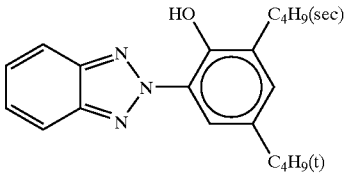

(UV-6) Ultraviolet Absorbent

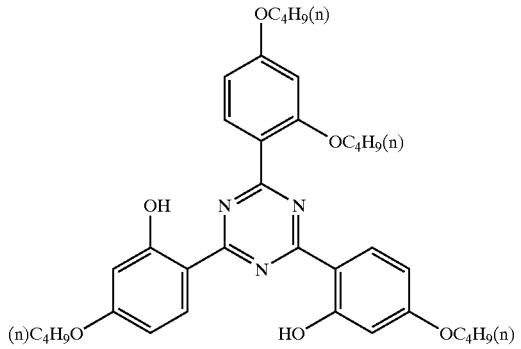

(Solv-1)

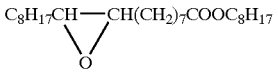

(Solv-2)

1:1 (by mass) Mixture of (Solv-2)

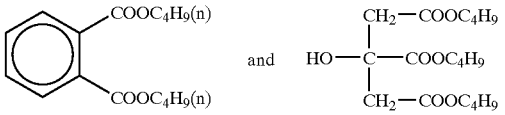

(Solv-3)

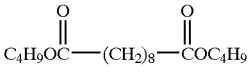

(Sov-4)

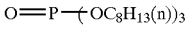

(Solv-5)

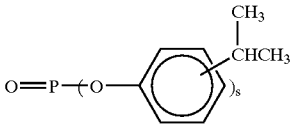

(Solv-6)

1:1 (by mass) Mixture of

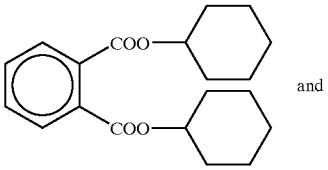

-continued

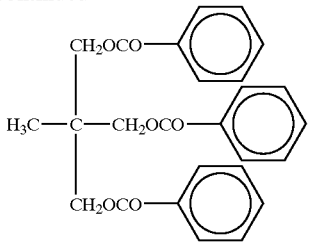

(Solv-7)

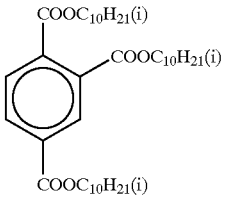

(2) Processing

<Exposure and Processing Conditions for Color Paper>

Photographs of persons standing in the middle-distant sunshiny outdoors were gotten on a commercially available color negative film, Fuji Color SUPERIA 400 (trade name, a product of Fuji Photo Film Co., Ltd.), and developed with an automatic developing machine, Model FP-363SC (trade name, made by Fuji Photo Film Co., Ltd.), using the color negative film processing formula CN-16S and its processing chemicals (trade name, a product of Fuji Photo Film Co., Ltd.).

The image information of the developed color negative film was read with a mini-lab printer processor, Frontier 340E (trade name, made by Fuji Photo Film Co., Ltd.), and the Sample No. 101 was exposed by means of a laser exposure unit bearing the thus read image information and then subjected to continuous processing performed using the following processing solutions in accordance with the following processing steps until the development-conditions were in running equilibrium (the cumulative volume of the replenisher supplied to the developer became 4 times the developing tank volume).

Additionally, modifications were made to the tanks and the racks of Frontier 340E so that the processing was accomplished in the following processing steps, and besides, additional box-form feeder mode of replenishing apparatus was installed for adding a granular replenishing agent directly to a processing tank and additional replenishing apparatus for direct addition of water to a processing tank was also installed. By use of this modified developing machine, the processing was performed while supplying a solid replenishing agent and water.

Incidentally, the replenishing agent used in the color development was the granulated matter 8-granulated matter 7 (4:1 by mass) mixture disclosed in Example 1 of JP-A-2001-183779, and the replenishing agent used in bleach-fix processing was the regenerated replenishing agent obtained by mixing any of the solid agents (described as regenerated agents in Table 1) prepared by the following preparation methods (Preparations A to D) with a non-regenerated new replenishing agent in proportions set forth in Table 1. And the waste solutions from individual processing steps were gathered together in one waste storage tank and used in the following preparation methods (Preparations A to D) for reuse of water solutions.

<Processing Steps>

| Processing Step | Temperature | Time | Amount replenished* (granular agent) | Amount replenished* water |
|---|---|---|---|---|
| Color development | 45° C. | 25 sec | 4 g | 45 mL |
| Bleach-fix | 40° C. | 25 sec | shown in Table 1 | 28 mL |
| Rinse 1** | 40° C. | 7 sec | — | |
| Rinse 2** | 40° C. | 4 sec | — | |
| Rinse 3** | 40° C. | 4 sec | — | |
| Rinse 4** | 40° C. | 7 sec | | 240 mL |
| Drying | 80° C. | 30 sec | | |

*Replenisher volume was per $m^2$ of photosensitive material.
**In rinsing process, 4-stage countercurrent method from rinse 4 to rinse 1 was adopted.
***Overflows from individual steps were gathered together and stored in one tank as the waste solution.

The composition of each processing solution is described below.

| [Color developer] | |
|---|---|
| Water | 800 mL |
| Surfactant of dimethylpolysiloxane type (Silicone KF351A, trade name, produced by Shin-Etsu Chemical Co., Ltd.) | 0.1 g |
| m-Carboxymethylbenzenesulfinic acid | 5.0 g |
| Ethylenediaminetetraacetate | 4.0 g |
| Potassium chloride | 10.0 g |
| Potassium bromide | 0.04 g |
| Sodium sulfite | 0.1 g |
| Brightening agent Hakkol FWA-SF (trade name, produced by Showa Chemicals) | 4.0 g |
| Sodium p-toluenesulfonate | 20.0 g |
| Potassium carbonate | 27.0 g |
| Disodium N,N-bis(sulfonatoethyl)hydroxylamine | 5.0 g |
| N-Ethyl-N-(β-methanesulfonamidoethyl)-3-methyl-4-aminoaniline 3/2 sulfate monohydrate | 7.0 g |
| Water to make | 1,000 mL |
| pH (adjusted with potassium hydroxide and sulfuric acid at 25° C.) | 10.25 |
| [Bleach-Fix Bath] | |
| Water | 600 mL |
| Ammonium thiosulfate (750 g/l) | 110 mL |
| Ammonium sulfite | 40.0 g |
| Ammonium ethylenediaminetetraacetatoferrate (III) | 46.0 g |
| Ethylenediaminetetraacetic acid | 5.0 g |
| Succinic acid | 20.0 g |
| Water to make | 1,000 mL |
| pH (adjusted with nitric acid and aqueous ammonia at 25° C.) | 5.50 |
| [Rinsing Bath] | |
| Sodium chloroisocyanurate | 0.02 g |
| Deionized water (conductivity: 5 μS/cm or below) | 1,000 mL |
| pH | 6.5 |

(3) Preparation of Replenishing Agent for Bleach-fix Bath

<Preparation A>

At the time when a mixture of waste solutions discharged from the aforementioned color developing, bleach-fix and rinsing tanks accumulated to 230 mL (which corresponded to the processing quantity of a 1 $m^2$ of photosensitive material), the mixture of waste solutions was solidified using a flash evaporator, EYELA Thin Film Evaporator F-70 (trade name, purchased from IKEDARIKA INC.), under conditions that the vacuum degree was kept at 30 to 40 hPa and the temperature at 80° C. Thereafter, the solidified matter was crushed, and then granulated with a granulator, CF-1000 (made by Freund Industrial Co., Ltd.). An about 10 g portion of the granules thus formed was withdrawn. These granules were referred to as Granule A. This Granule A and the granulated matter 7 as prepared in Example 2 of JP-A-2001-183779 (the granular agent for bleach-fix bath, described simply as Granulated Matter in Table 1) were mixed in proportions (by mass) shown in Table 1. Each of the granular mixtures thus obtained was used as a replenishing agent added to the bleach-fix bath for processing the 1 $m^2$ of photosensitive material.

<Preparation B>

Granule B was formed in the same process as Granule A, except that the temperature of the flash evaporator used for dry-solidification was changed to 100° C. And replenishing agents for the bleach-fix bath were prepared in the same manner as in Preparation A, except that Granule B was used instead of Granule A.

<Preparation C>

Granule C was formed in the same process as Granule A, except that the temperature of the flash evaporator used for dry-solidification was changed to 120° C. And replenishing agents for the bleach-fix bath were prepared in the same manner as in Preparation A, except that Granule C was used instead of Granule A.

<Preparation D>

As a comparative replenishing agent, the waste solutions were pulverized using the processing-solution recovery apparatus disclosed in FIG. 1 of JP-A-10-288829 (wherein silver was removed from waste solutions by electrolysis). An about 10 g portion of the powder thus formed was withdrawn. This powder was referred to as Powder D. This Powder D was mixed with the same granulated matter as mentioned above, and used as a replenishing agent added to the bleach-fix bath for processing the 1 $m^2$ of photosensitive material.

(4) Evaluation of Desilvering Characteristics

Evaluation of desilvering characteristics was made by the quantity of residual silver. More specifically, the quantity of silver remaining in the area where the processed color paper had undergone maximum exposure (10 CMS) was measured with a fluorescent X-ray analyzer.

(5) Evaluation of Contamination of Photosensitive Material

After running the aforementioned processing operations, Sample No. 101 cut into L-size (89 mm×127 mm), 2L-size (127 mm×178 mm) and quarto-size (203 mm×254 mm) sheets was subjected to processing without undergoing any exposure. In the processing, 20 sets of 3 sheets having L, 2L and quarto sizes was used, and the white backgrounds of these 60 sample sheets were checked visually and evaluated by the following criteria:

A . . . No sample sheet suffered contamination.

B . . . Among 60 sample sheets, 1 to 5 contamination spots were observed.

C . . . Among 60 sample sheets, 6 to 10 contamination spots were observed.

D . . . Among 60 sample sheets, 11 or more contamination spots were observed.

Results obtained are shown in Table 1.

TABLE 1

| Experiment | Preparation method of replenishing agent | Mixing amounts of regenerated granules and granulated matter (per $m^2$ of CLP) | Reuse rate of waste solutions (%) | Quantity of residual silver ($\mu g/cm^2$) | Contamination of sensitive material | note |
|---|---|---|---|---|---|---|
| 1 | Preparation A | 10 g of Granule A + 0.7 g of granulated matter | 100 | 4.6 | B | invention |
| 2 | " | 9 g of Granule A + 1.4 g of granulated matter | 90 | 2.1 | A | invention |
| 3 | " | 8 g of Granule A + 2.1 g of granulated matter | 80 | 1.9 | A | invention |
| 4 | Preparation B | 10 g of Granule B + 0.7 g of granulated matter | 100 | 5.3 | B | invention |
| 5 | " | 9 g of Granule B + 1.4 g of granulated matter | 90 | 2.4 | B | invention |
| 6 | " | 8 g of Granule B + 2.1 g of granulated matter | 80 | 2.2 | B | invention |
| 7 | Preparation C | 10 g of Granule C + 0.7 g of granulated matter | 100 | 6.7 | B | invention |
| 8 | " | 9 g of Granule C + 1.4 g of granulated matter | 90 | 3.3 | B | invention |
| 9 | " | 8 g of Granule C + 2.1 g of granulated matter | 80 | 3.0 | B | invention |
| 10 | Preparation D | 10 g of Powder D + 0.7 g of granulated matter | 100 | 7.3 | C | comparison |
| 11 | " | 9 g of Powder D + 1.4 g of granulated matter | 90 | 5.4 | C | comparison |
| 12 | " | 8 g of Powder D + 2.1 g of granulated matter | 80 | 5.2 | C | comparison |

(6) Results

In the comparative experiments 10 to 12 where the electrolytic removal of silver had been performed, as can be seen from Table 1, desilvering characteristics were not good and the photosensitive material suffered much contamination. On the other hand, all the present regenerated agents obtained by granulating the powders prepared by performing dry-solidification of the waste solution with the flash evaporator of thin-film type and not performing electrolytic removal of silver, and then mixing the thus granulated powders with the non-regenerative granulated matter were significantly superior to the regenerated agents obtained in the comparative experiments. Of the present regenerated agents, those obtained in the present experiments 1, 4 and 7 where the reuse rate of the waste solution was 100% resulted in greater quantities of residual silver than the others, and were inferior in contamination of the photosensitive material to the others. Additionally, in the present experiments 4 to 9 where the drying temperature was higher than 100° C., slight contamination of the photosensitive material was caused. By contrast, the present experiments 2 and 3 wherein the waste solution was dried at evaporation temperature of 80° C. or lower without undergoing electrolytic removal of silver and the reuse rates thereof were 90% and 80%, respectively, offered excellent desilvering characteristics and no contamination of the photosensitive material.

Example 2

The same experiment as the present experiment 3 of Example 1 was carried out, except that the water evaporated during the solidification of the waste solution was recovered and reused for replenishing the bleach-fix bath and the rinsing bath, and therein the same processing performances as in the present experiment 3 of Example 1 were achieved. This result indicates that the effluent quantity can be further reduced.

In accordance with the present method of reusing a photographic processing waste solution in which the waste solution is dry-solidified in its total amount without removal of any accumulated ingredients including silver and then granulated, apparatus for developing and regenerating waste solutions can be downsized and reduced in cost with ease, and excellent effect of substantially avoiding discharge of photographic processing effluents can be achieved. Further, the processing chemicals regenerated by the invention (solid processing chemicals) can produce excellent effects of offering satisfactory desilvering characteristics and avoiding contamination of photosensitive materials.

This application is based on Japanese patent application JP 2003-049202, filed on Feb. 26, 2003, the entire content of which is hereby incorporated by reference, the same as if set forth at length.

What is claimed is:

1. A method of reusing a photographic processing waste solution, comprising:

preparing a solidified matter from the photographic processing waste solution by a dry-solidification according to a thin film concentration method without removing ingredients accumulated during a photographic processing;

forming the solidified matter into granules; and reusing the granules as a solid photographic processing agent.

2. The method as described in claim 1, which further comprises gathering waste solutions discharged in individual steps of photographic processing; and mixing the gathered waste solutions without removing ingredients accumulated in the individual steps.

3. The method as described in claim 1, which further comprises adding a chemical consumed during the photographic processing.

4. The method as described in claim 1, wherein the photographic processing waste solution is a waste solution generated by a color paper processing.

5. The method as described in claim 1, wherein the solidified matter is prepared from the photographic processing waste solution by a dry-solidification according to a thin film concentration method at a temperature of 80° C. or below.

6. The method as described in claim 1, wherein the solidified matter is prepared from the photographic processing waste solution by a dry-solidification according to a thin film concentration method at a temperature of 80° C. or below under a reduced pressure.

7. The method as described in claim 1, wherein the solidified matter is prepared from the photographic processing waste solution by a dry-solidification according to a thin film concentration method without removing at least silver accumulated during the photographic processing.

8. The method as described in claim 1, wherein a reuse rate is from 70% to 90%, in which the reuse rate means a rate by weight of the amount of the solid matter obtained from the photographic waste solutions and reused as a replenishing agent to the total amount by weight of the solid matter obtained from the photographic waste solutions.

9. The method as described in claim 1, which further comprises: recovering water vapor produced at the time of the dry-solidification of the photographic waste solutions; and liquefying the water vapor to utilize the water as the water for diluting the bleach-fix processing solution or the water of the rinsing bath.

10. The method as described in claim 1, wherein the photographic processing waste solution is a mixture of processing waste solutions discharged in a development-processing step, a bleach-fix processing step and at least one of a rinse and stabilization-processing step.

* * * * *